US009951403B2

(12) United States Patent
Matsui et al.

(10) Patent No.: US 9,951,403 B2
(45) Date of Patent: Apr. 24, 2018

(54) HOT-FORGED SECTION MATERIAL AND COMMON RAIL

(71) Applicants: NIPPON STEEL & SUMITOMO METAL CORPORATION, Tokyo (JP); DENSO CORPORATION, Aichi (JP)

(72) Inventors: Naoki Matsui, Tokyo (JP); Masashi Higashida, Tokyo (JP); Hitoshi Matsumoto, Tokyo (JP); Yutaka Neishi, Tokyo (JP); Taizo Makino, Tokyo (JP); Kouji Morita, Aichi (JP); Yoshihiro Tanimura, Aichi (JP); Naoyuki Sashima, Aichi (JP); Toshimasa Itou, Aichi (JP)

(73) Assignees: NIPPON STEEL & SUMITOMO METAL CORPORATION, Tokyo (JP); DENSO CORPORATION, Aichi (JP)

( * ) Notice: Subject to any disclaimer, the term of this patent is extended or adjusted under 35 U.S.C. 154(b) by 748 days.

(21) Appl. No.: 14/378,686

(22) PCT Filed: Feb. 5, 2013

(86) PCT No.: PCT/JP2013/052579
§ 371 (c)(1),
(2) Date: Aug. 14, 2014

(87) PCT Pub. No.: WO2013/121930
PCT Pub. Date: Aug. 22, 2013

(65) Prior Publication Data

US 2015/0034049 A1 Feb. 5, 2015

(30) Foreign Application Priority Data

Feb. 15, 2012 (JP) ..... 2012-030158

(51) Int. Cl.

| | |
|---|---|
| ***C22C 38/50*** | (2006.01) |
| ***C21D 8/06*** | (2006.01) |
| ***C22C 38/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/14*** | (2006.01) |
| ***C22C 38/16*** | (2006.01) |
| ***C22C 38/24*** | (2006.01) |
| ***C22C 38/28*** | (2006.01) |
| ***B21K 3/00*** | (2006.01) |
| ***C22C 38/22*** | (2006.01) |
| ***C22C 38/46*** | (2006.01) |
| ***F02M 63/02*** | (2006.01) |
| *C21D 8/10* | (2006.01) |
| *C21D 9/14* | (2006.01) |

(52) U.S. Cl.
CPC ..... *C22C 38/50* (2013.01); *B21K 3/00* (2013.01); *C21D 8/06* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/28* (2013.01); *C22C 38/46* (2013.01); *F02M 63/0275* (2013.01); *C21D 8/10* (2013.01); *C21D 9/14* (2013.01); *C21D 2211/004* (2013.01)

(58) Field of Classification Search
None
See application file for complete search history.

(56) References Cited

U.S. PATENT DOCUMENTS

2004/0223867 A1 11/2004 Tsunekage

FOREIGN PATENT DOCUMENTS

| | | |
|---|---|---|
| EP | 2 216 423 | 8/2010 |
| EP | 2 784 169 | 10/2014 |
| JP | 10-195599 | 7/1998 |

(Continued)

OTHER PUBLICATIONS

English machine translation of JP 2010-265506 A of Tanaka et al., published Nov. 25, 2010.*

(Continued)

*Primary Examiner* — Roy V King
*Assistant Examiner* — Jophy S. Koshy
(74) *Attorney, Agent, or Firm* — Clark & Brody

(57) ABSTRACT

A rolled steel bar for hot forging consisting, by mass percent, of C: 0.25-0.50%, Si: 0.40-1.0%, Mn: 1.0-1.6%, S: 0.005-0.035%, Al: 0.005-0.050%, V: 0.10-0.30%, and N: 0.005-0.030%, and the balance of Fe and impurities, i.e., P: 0.035% or less and O: 0.0030% or less, wherein Fn1=C+Si/10+Mn/5+5Cr/22+1.65V−5S/7 is 0.90 to 1.20. The predicted maximum width of nonmetallic inclusions at the time when a cumulative distribution function obtained by extreme value statistical processing by taking the width of nonmetallic inclusion in an $R_1/2$ part of a longitudinal cross section of the steel bar as W (μm) is 99.99% is 100 μm or narrower. The number density of sulfides each having a circle-equivalent diameter of 0.3 to 1.0 μm observed per unit area of the $R_1/2$ part of a transverse cross section of the steel bar is 500 pieces/mm$^2$ or higher.

4 Claims, 2 Drawing Sheets

(56) References Cited

FOREIGN PATENT DOCUMENTS

| | | |
|---|---|---|
| JP | 2004-083986 | 3/2004 |
| JP | 2005-154886 | 6/2005 |
| JP | 2007-231353 | 9/2007 |
| JP | 2009-287108 | 12/2009 |
| JP | 2010-265506 | 11/2010 |
| JP | 2011-241465 | 12/2011 |
| WO | 2009/064013 | 5/2009 |
| WO | 2010/103772 | 9/2010 |

OTHER PUBLICATIONS

Akira Suzuki et al., "On Space...Carbon Content", Journal of Japan Institute of Metals, 32(1968), pp. 1301-1305.

* cited by examiner

HOT-FORGED SECTION MATERIAL AND COMMON RAIL

TECHNICAL FIELD

The present invention relates to a rolled steel bar for hot forging, a hot-forged section material, a common rail, and a method for producing the common rail. More particularly, it relates to a rolled steel bar for hot forging suitable as a starting material for a common rail used for a diesel engine fuel injection system, a hot-forged section material produced by forming the rolled steel bar, the common rail, and a method for producing the common rail.

BACKGROUND ART

With environmental problems in the background, a need for improving fuel economy has increased. For parts for mechanical structures used for motor vehicles, industrial machines, and the like, the increase in strength of part has been desired in order to reduce the size thereof.

In recent years, the regulation of exhaust gas for motor vehicles tends to be increasingly stricter. For a diesel engine fuel injection system, the combustion efficiency of engine can be enhanced by increasing the injection pressure of fuel. Accordingly, the injection pressure of fuel injected into a diesel engine has been raised. A common rail is a hollow shaped part that is used for the diesel engine fuel injection system and temporarily stores the pressurized fuel before the fuel is injected into the engine.

The interior of common rail is repeatedly subjected to a high internal pressure. Therefore, a steel material used for the common rail is required to have a high fatigue strength against the internal pressure, to have a high fracture toughness to prevent brittle fracture even if a fatigue crack is generated by the repeatedly applied internal pressure, to have high machinability to facilitate the formation of a plurality of intersecting holes formed in the part, and so on. With the increase in injection pressure of fuel injection system, further enhancement of performance has been desired on the steel material used for the common rail as well.

On the other hand, from the viewpoint of production cost of parts, it is desirable to use, for the common rail, a non-thermally refined steel material in which a steel bar produced by hot rolling (hereinafter, a steel bar as is hot-rolled, which steel bar is produced by hot rolling is referred to as a "rolled steel bar") is formed by hot forging (hereinafter, a rolled steel bar as is formed by hot forging is referred to as a "hot-forged section material"), and a desired strength can be obtained without performing heat treatment of quenching and tempering, that is, "thermal refining treatment".

Thus, as a steel material used for a common rail, it is desired to apply the rolled steel bar that can be formed into a part shape by cutting work before use, without thermal refining treatment after the hot-forged section material has been produced by hot forging.

So far, various techniques for improving the fatigue strength and the like of a part used for the fuel injection system have been proposed.

Patent Document 1 discloses a free cutting steel that contains Bi and S as inclusion forming elements, and is provided with both of high fatigue strength and excellent machinability, and a fuel injection system part using the free cutting steel.

Patent Document 2 discloses a steel for common rail excellent in fatigue properties, in which REM is contained, and the dispersion mode of sulfide-based inclusions, nitride-based inclusions, and oxide-based inclusions is controlled, and a common rail.

Patent Document 3 discloses a steel-made high-strength fabricated product excellent in shock resistance and balance of strength-ductility, in which a steel material containing a proper amount of one or more elements selected from a group consisting of Nb, Ti and V and a proper amount of Al is used, and the metal micro-structure of the steel material is made to consist of ferrite, retained austenite, and bainite and/or martensite by controlling the cooling after hot forging.

Patent Document 4 discloses a steel excellent in fatigue properties in which the length-to-width ratio of Mn sulfide-based inclusion is made a certain value or lower, and a steel part produced from the steel.

Patent Document 5 discloses a ferrite/pearlite type non-thermally refined steel for hot forging, in which the contents of C, S and V are especially controlled, and the fatigue strength and the cutting workability using a cemented carbide drill are excellent, and a common rail using the non-thermally refined steel.

LIST OF PRIOR ART DOCUMENTS

Patent Document

Patent Document 1: JP2005-154886A
Patent Document 2: JP2009-287108A
Patent Document 3: JP2007-231353A
Patent Document 4: JP2004-83986A
Patent Document 5: JP2010-265506A

Non Patent Document

Non-Patent Document 1: Akira Suzuki, Takeshi Suzuki, Yutaka Nagaoka, and Yoshihiro Iwata: On Space Between Secondary Dendrite Arms of Carbon Steel Different in Carbon Content, Journal of the Japan Institute of Metals, 32 (1968), pp. 1301-1305

DISCLOSURE OF THE INVENTION

Problems to be Solved by the Invention

In the techniques described in Patent Documents 1 and 2, the steel must contain expensive alloying elements such as Bi and REM to improve the machinability, so that the cost increases. In Patent Document 2, the thermal refining treatment leads to a further increase in cost.

Also, in the technique described in Patent Document 3, the production process for forming the metal micro-structure of part which consists of ferrite, retained austenite, and bainite and/or martensite is complicated, so that the production cost of part increases. Further, the amount of Al contained in the steel material is large, and the metal micro-structure contains martensite or bainite, so that the steel, which is a starting material for the part, is not necessarily excellent in machinability.

In the technique described in Patent Document 4, to control the length-to-width ratio of Mn sulfide-based inclusion, the steel contains one element or two or more elements of Mg, Ca, Zr, Te, and REM. Therefore, the cost of alloying elements contained in the starting material increases. Also, coarse oxides sometimes exist in the steel, so that an excellent fatigue strength cannot necessarily be attained.

In the technique described in Patent Document 5, although S is contained in the steel and sulfides are dispersed in the steel to enhance the machinability, an excellent fatigue strength cannot necessarily be attained because of coarse sulfides or oxides. Also, the mixed structure of ferrite and pearlite (hereinafter, referred to as a "ferrite/pearlite structure") is not made proper, so that a excellent fracture toughness value necessary for the common rail used for a fuel injection system having a higher injection pressure cannot necessarily be obtained.

Accordingly, an objective of the present invention is to provide a rolled steel bar for hot forging capable of being produced at a low cost, which steel bar is excellent in fatigue strength, fracture toughness value, and machinability without being subjected to thermal refining treatment, and is suitable as a starting material for a common rail for a fuel injection system used at a high injection pressure, a hot-forged section material produced by hot-forging the rolled steel bar, and a method for producing the common rail using the section material.

Means for Solving the Problems

The common rail for a fuel injection system used at a high injection pressure is produced by the method described below. First, after a rolled steel bar, which is a starting material, has been heated, the rolled steel bar is formed into a hot-forged section material by pressing down the rolled steel bar in the direction perpendicular to the rolling direction of the rolled steel bar due to hot forging. Then, in the hot-forged section material, a through hole is formed in the center axis direction (the rolling direction of the rolled steel bar, which is a starting material) of the center part of the transverse cross section thereof by cutting work using a drill, and minute holes are also formed by cutting work so as to intersect with the through hole. In the interior of common rail in which the through hole has been formed in the center part, the pressure accumulation (pressurizing) and pressure discharge (depressurizing) of fuel are repeated at a high pressure. Therefore, a tensile stress acts repeatedly in the circumferential direction of the inner surface of the through hole of common rail. Accordingly, the common rail is required to have a high fatigue strength against the stress in the direction perpendicular to the center axis of common rail (hereinafter, the fatigue strength against the stress in the direction perpendicular to the center axis is referred to as a "transverse fatigue strength").

Since the hot-forged section material is produced by pressing down and forming the rolled steel, which is a starting material, in the direction perpendicular to the rolling direction of the rolled steel bar as described above, the sizes and distribution state of nonmetallic inclusions in the rolled steel bar, which inclusions have been elongated in the rolling direction due to hot rolling, are transferred to the hot-forged section material almost as they are. Therefore, for the common rail formed with the through hole in the center part of the hot-forged section material, the nonmetallic inclusions elongated in the direction parallel with the center axis (the rolling direction of the rolled steel bar, which is a starting material) are distributed, so that the transverse fatigue strength tends to decrease.

In order to obtain a common rail having a high transverse fatigue strength, the transverse fatigue strength has to be enhanced in the state of the hot-forged section material before the through hole and minute holes are formed. For this purpose, the tensile strength of the hot-forged section material has to be high. However, if the tensile strength of the non-thermally refined hot-forged section material is enhanced, the machinability is decreased in the cutting process in which the hot-forged section material is cut in a non-thermally refined state. As a result, the cutting cost rises, and also the cutting time is prolonged.

Furthermore, the non-thermally refined hot-forged section material in which the tensile strength is enhanced for increasing the transverse fatigue strength has a tendency for the fracture toughness value to decrease. If the fracture toughness value is low, brittle fracture may occur in the case where a fatigue crack is generated by the internal pressure repeatedly applied in the interior of common rail. For the hot-forged section material, therefore, both of the tensile strength and the fracture toughness value has to be high.

Also, in recent years, since the miniaturization of common rail has been advanced to decrease the weight thereof, the cooling rate after hot forging tends to have increased naturally. If the cooling rate after hot forging increases, bainite is easily formed. The formation of bainite is unfavorable in terms of the machinability and fracture toughness value of the hot-forged section material.

Accordingly, the present inventors examined in detail the relationship between the chemical composition, micro-structure, and sizes and distribution of nonmetallic inclusions of the steel material and the transverse fatigue strength, fracture toughness value, and machinability. As the result, the present inventors came to obtain the following findings.

(a) In order to obtain a non-thermally refined hot-forged section material excellent in transverse fatigue strength and fracture toughness value after hot forging has been performed, the internal structure excluding the decarburized layer formed on the surface of the hot-forged section material has to be made the ferrite/pearlite structure.

(b) In order to avoid the formation of bainite after hot forging and to provide a high tensile strength (especially a tensile strength of 900 MPa or higher), the contents of alloying elements for improving the hardenability have to be controlled strictly.

(c) In order to increase the fracture toughness value of the non-thermally refined hot-forged section material, it is effective to increase the area of austenite grain boundary after hot forging, that is, to suppress the growth of austenite grains during hot forging. By suppressing the growth of austenite grains, a hot-forged section material having fine metal micro-structure can be obtained.

(d) In order to suppress the growth of austenite grains during hot forging, it is effective to disperse a large number of fine sulfides each having a size of 0.3 to 1.0 μm in the state of the rolled steel bar, which is a starting material. The number density of fine sulfides each having a size of 0.3 to 1.0 μm is determined by the solidification conditions and the heating conditions at the time of subsequent blooming and steel bar rolling. A cast piece and an ingot having different cooling rate at the time of solidification were heated at the same temperature and were rolled, and a comparison was made between the number density of fine sulfides in the rolled steel bar and the micro-structure of the hot-forged section material after hot forging. As the result, it was found that even in steels having the same chemical composition, in the case where the cooling rate from solidification start to solidification finish is high, the number density of fine sulfides in the rolled steel bar increases, and the structure of the hot-forged section material is a fine ferrite/pearlite structure.

(e) Even in steels having the same chemical composition, if nonmetallic inclusions each having a great width exist, the transverse fatigue strength of the hot-forged section material decreases. Therefore, in order to obtain a hot-forged section material having a high transverse fatigue strength, the predicted maximum width of nonmetallic inclusions at the time when a cumulative distribution function predicted by extreme value statistical processing at a position corresponding to an $R_1/2$ part ($R_1$: radius of rolled steel bar) of a surface through which the rolled steel bar is cut in parallel with the rolling direction is 99.99% has to be 100 μm or narrower.

(f) In hot rolling, by applying rolling reduction of a certain amount or larger, a coarse nonmetallic inclusion is elongated and cut, and the width of the nonmetallic inclusion can be decreased.

(g) Furthermore, by making the chemical composition and the area fraction of pearlite in the center part of the hot-forged section material proper, the machinability at the time when the through hole is formed in the center part of the hot-forged section material is improved.

(h) As the result, a non-thermally refined hot-forged section material having a tensile strength of 900 MPa or higher, a transverse fatigue strength of 430 MPa or higher, a fracture toughness value $K_Q$ of 40 MPa·$m^{1/2}$ or higher, and excellent machinability can be obtained.

(i) The non-thermally refined hot-forged section material thus obtained is excellent in tensile strength, transverse fatigue strength, fracture toughness value, and machinability, and therefore is suitable for a common rail used for a diesel engine fuel injection system.

The present invention has been accomplished on the basis of the above-described findings, and involves the rolled steel bar for hot forging, the hot-forged section material, the common rail, and the method for producing the common rail described below.

(1) A rolled steel bar for hot forging consisting, by mass percent, of C: 0.25 to 0.50%, Si: 0.40 to 1.0%, Mn: 1.0 to 1.6%, S: 0.005 to 0.035%, Al: 0.005 to 0.050%, V: 0.10 to 0.30%, and N: 0.005 to 0.030%, and the balance of Fe and impurities, the contents of P and O in the impurities being P: 0.035% or less and O: 0.0030% or less, and Fn1 represented by Formula (i) being 0.90 to 1.20, wherein the predicted maximum width of nonmetallic inclusions at the time when a cumulative distribution function obtained by extreme value statistical processing by taking the width of nonmetallic inclusion in an $R_1/2$ part ($R_1$: radius of rolled steel bar) of a longitudinal cross section of the rolled steel bar as W (μm) is 99.99% is 100 μm or narrower; and the number density of sulfides each having a circle-equivalent diameter of 0.3 to 1.0 μm observed per unit area of the $R_1/2$ part of a transverse cross section of the rolled steel bar is 500 pieces/$mm^2$ or higher;

$$Fn1=C+Si/10+Mn/5+5Cr/22+1.65V-5S/7 \quad (i)$$

where, the symbol of an element in Formula (i) represents the content (mass %) of the element.

(2) A rolled steel bar for hot forging consisting, by mass percent, of C: 0.25 to 0.50%, Si: 0.40 to 1.0%, Mn: 1.0 to 1.6%, S: 0.005 to 0.035%, Al: 0.005 to 0.050%, V: 0.10 to 0.30%, and N: 0.005 to 0.030%, and one or more elements selected from the following items (a) and (b), and the balance of Fe and impurities, the contents of P and O in the impurities being P: 0.035% or less and O: 0.0030% or less, and Fn1 represented by Formula (i) being 0.90 to 1.20, wherein the predicted maximum width of nonmetallic inclusions at the time when a cumulative distribution function obtained by extreme value statistical processing by taking the width of nonmetallic inclusion in an $R_1/2$ part ($R_1$: radius of rolled steel bar) of a longitudinal cross section of the rolled steel bar as W (μm) is 99.99% is 100 μm or narrower; and the number density of sulfides each having a circle-equivalent diameter of 0.3 to 1.0 μm observed per unit area of the $R_1/2$ part of a transverse cross section of the rolled steel bar is 500 pieces/$mm^2$ or higher;

$$Fn1=C+Si/10+Mn/5+5Cr/22+1.65V-5S/7 \quad (i)$$

where, the symbol of an element in Formula (i) represents the content (mass %) of the element, (a) Ti: 0.030% or less (b) Cu: 0.30% or less, Ni: 0.20% or less, Cr: 0.50% or less, and Mo: 0.10% or less.

(3) A hot-forged section material consisting, by mass percent, of C: 0.25 to 0.50%, Si: 0.40 to 1.0%, Mn: 1.0 to 1.6%, S: 0.005 to 0.035%, Al: 0.005 to 0.050%, V: 0.10 to 0.30%, and N: 0.005 to 0.030%, and the balance of Fe and impurities, the contents of P and O in the impurities being P: 0.035% or less and O: 0.0030% or less, and Fn1 represented by Formula (i) being 0.90 to 1.20, wherein the predicted maximum width of nonmetallic inclusions at the time when a cumulative distribution function obtained by extreme value statistical processing by taking the width of nonmetallic inclusion in an $R_2/2$ part ($R_2$: radius of section material) or a T/4 part (T: thickness of section material) of a longitudinal cross section of the section material as W (μm) is 99.99% is 100 μm or narrower;

the internal structure is a ferrite/pearlite structure;

the average pearlite grain size in the $R_2/2$ part or T/4 part of a transverse cross section of the section material is 150 μm or smaller; and the area fraction of pearlite accounting for the micro-structure of the center part of section material is 75% or less;

$$Fn1=C+Si/10+Mn/5+5Cr/22+1.65V-5S/7 \quad (i)$$

where, the symbol of an element in Formula (i) represents the content (mass %) of the element.

(4) A hot-forged section material consisting, by mass percent, of C: 0.25 to 0.50%, Si: 0.40 to 1.0%, Mn: 1.0 to 1.6%, S: 0.005 to 0.035%, Al; 0.005 to 0.050%, V: 0.10 to 0.30%, and N: 0.005 to 0.030%, and one or more elements selected from the following items (a) and (b), and the balance of Fe and impurities, the contents of P and O in the impurities being P: 0.035% or less and O: 0.0030% or less, and Fn1 represented by Formula (i) being 0.90 to 1.20, wherein the predicted maximum width of nonmetallic inclusions at the time when a cumulative distribution function obtained by extreme value statistical processing by taking the width of nonmetallic inclusion in an $R_2/2$ part ($R_2$: radius of section material) or a T/4 part (T: thickness of section material) of a longitudinal cross section of the section material as W (μm) is 99.99% is 100 μm or narrower;

the internal structure is a ferrite/pearlite structure;

the average pearlite grain size in the $R_2/2$ part or T/4 part of a transverse cross section of the section material is 150 μm or smaller; and the area fraction of pearlite accounting for the micro-structure of the center part of section material is 75% or less;

$$Fn1=C+Si/10+Mn/5+5Cr/22+1.65V-5S/7 \quad (i)$$

where, the symbol of an element in Formula (i) represents the content (mass %) of the element;

(a) Ti: 0.030% or less (b) Cu: 0.30% or less, Ni: 0.20% or less, Cr: 0.50% or less, and Mo: 0.10% or less.

(5) A common rail that uses the hot-forged section material according to (3) or (4) as a starting material.

(6) A method for producing a common rail in which the hot-forged section material according to (3) or (4) is cut, and intersecting holes are formed therein.

The term "impurities" means components that are mixed in from raw materials such as ore and scrap, production environments, and the like when the steel is produced on an industrial basis.

In the present invention, the definitions listed in the following items (A) to (H) shall apply.

(A) The nonmetallic inclusions mean sulfides consisting mainly of MnS existing in the steel, oxides consisting mainly of $Al_2O_3$, and nitrides consisting mainly of TiN.

(B) The $R_1/2$ part means a part including the $R_1/2$ position in the visual field when the longitudinal cross section and transverse cross section are observed under an optical microscope. Also, the $R_2/2$ part means a part including the $R_2/2$ position in the visual field when the longitudinal cross section or transverse cross section is observed under an optical microscope, and the T/4 part means a part including the T/4 position in the visual field when the longitudinal cross section or transverse cross section is observed under an optical microscope.

(C) The longitudinal cross section means a surface through which the rolled steel bar for hot forging is cut in parallel with the rolling direction passing through the center axis thereof, or a surface through which the hot-forged section material is cut in parallel with the center axis (the rolling direction of the rolled steel bar, which is a starting material) passing through the center axis. Likewise, the transverse cross section means a surface through which the rolled steel bar for hot forging is cut perpendicularly to the rolling direction, or a surface through which the hot-forged section material is cut perpendicularly to the center axis direction (the rolling direction of the rolled steel bar, which is a starting material).

(D) The intersecting holes mean the through hole formed in the center axis direction in the center part of the hot-forged section material and the minute holes formed so as to intersect with the through hole.

(E) The internal structure means a structure of a part excluding the decarburized layer formed on the surface of the hot-forged section material during hot forging.

(F) The predicted maximum width of nonmetallic inclusions at the time when a cumulative distribution function obtained by extreme value statistical processing by taking the width of nonmetallic inclusion in the $R_1/2$ part ($R_1$: radius of rolled steel bar) of a longitudinal cross section of the rolled steel bar for hot forging as W (μm) is 99.99% is hereinafter referred simply as the "predicted maximum width of nonmetallic inclusions of the rolled steel bar" in some cases.

(G) The predicted maximum width of nonmetallic inclusions at the time when a cumulative distribution function obtained by extreme value statistical processing by taking the width of nonmetallic inclusion in the $R_2/2$ part ($R_2$: radius of section material) or the T/4 part (T: thickness of section material) of a longitudinal cross section of the section material as W (μm) is 99.99% is hereinafter referred simply as the "predicted maximum width of nonmetallic inclusions of the section material" in some cases.

(H) The number density of sulfides with a circle-equivalent diameter of 0.3 to 1.0 μm observed per unit area of the $R_1/2$ part of the transverse cross section of the rolled steel bar for hot forging is hereinafter referred simply as the "number density of sulfides with a circle-equivalent diameter of 0.3 to 1.0 μm of the rolled steel bar" in some cases.

Advantageous Effects of the Invention

By using the rolled steel bar for hot forging of the present invention as a starting material, a non-thermally refined hot-forged section material excellent in transverse fatigue strength, fracture toughness value, and machinability can be obtained. Also, by forming intersecting holes in the hot-forged section material of the present invention, a common rail for a fuel injection system used at a high injection pressure can be produced at a low cost.

MODE FOR CARRYING OUT THE INVENTION

Figure 1:
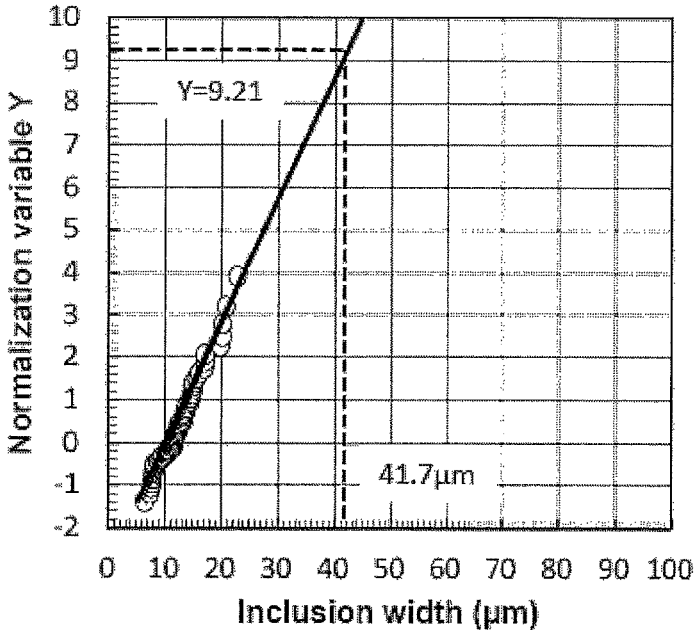
FIG. 1 is a graph showing an example of the case where the predicted maximum width of nonmetallic inclusions at the time when a cumulative distribution function obtained by extreme value statistical processing is 99.99% is 41.7 μm.

The requisites for the present invention will now be described in detail. The symbol "%" for the content of each element means "% by mass".

1. Chemical Composition of Rolled Steel Bar for Hot Forging and Hot-Forged Section Material C: 0.25 to 0.50%

C (carbon) is an element for strengthening a steel, and therefore 0.25% or more of C has to be contained. On the other hand, if the content of C is more than 0.50%, although the tensile strength after hot forging increases, the fracture toughness value and machinability decrease. Therefore, the content of C is set to 0.25 to 0.50%. The C content is preferably 0.29% or more, and preferably 0.45% or less.

Si: 0.40 to 1.0%

Si (silicon) is a deoxidizing element, and also is an element necessary for strengthening ferrite by means of solid-solution strengthening and for enhancing the tensile strength after hot forging. In order to achieve these effects, 0.40% or more of Si has to be contained. On the other hand, if the content of Si is more than 1.0%, not only the effects are saturated, but also decarburization of the surfaces of the rolled steel bar for hot forging and non-thermally refined hot-forged section material becomes remarkable. Therefore, the content of Si is set to 0.40 to 1.0%. The Si content is preferably 0.45% or more, and preferably 0.80% or less.

Mn: 1.0 to 1.6%

Mn (manganese) is an element necessary for strengthening ferrite by means of solid-solution strengthening and for enhancing the tensile strength after hot forging, and therefore 1.0% or more of Mn has to be contained. On the other hand, if the content of Mn is more than 1.6%, not only the effects are saturated, but also the hardenability is enhanced, bainite is formed after hot forging, and the fracture toughness value may be decreased. Therefore, the content of Mn is set to 1.0 to 1.6%. The Mn content is preferably 1.1% or more, and preferably 1.4% or less.

S: 0.005 to 0.035%

S (sulfur) is an important element in the present invention. Sulfur combines with Mn to form sulfides. In particular, if a large number of sulfides each having a circle-equivalent diameter of 0.3 to 1.0 μm exist in the rolled steel bar, an effect of suppressing the growth of austenite grains in hot forging is achieved. Therefore, if the number density of fine sulfides is increased, the structure of hot-forged section material is refined, and the fracture toughness value can be increased. Furthermore, the machinability is improved by sulfides. In order to achieve these effects, 0.005% or more of S must be contained. On the other hand, if the content of S is more than 0.035%, sulfides each having a great width come to exist, and thereby the transverse fatigue strength is decreased. Therefore, the content of S is set to 0.005 to 0.035%. The S content is preferably 0.010% or more, and preferably less than 0.030%, further preferably 0.025% or less.

Al: 0.005 to 0.050%

Al (aluminum) has functions of not only a deoxidizing, but also suppressing the growth of austenite grains during hot forging due to the pinning effect by combining with N to form fine AlN. Therefore, Al has an effect of making the structure of hot-forged section material fine, and increasing the fracture toughness value. For this purpose, 0.005% or more of Al has to be contained. On the other hand, if the content of Al is more than 0.050%, the effects thereof are saturated. Therefore, the content of Al is set to 0.005 to 0.050%. The Al content is preferably 0.010% or more, and preferably 0.040% or less.

V: 0.10 to 0.30%

V (vanadium) has a function of effectively enhancing the transverse fatigue strength of non-thermally refined hot-forged section material by combining with C and N to form fine carbides, nitrides, or carbonitrides. Therefore, 0.10% or more of V has to be contained. On the other hand, if the content of V is more than 0.30%, not only the effect thereof is saturated, but also a rise in production cost and a decrease in fracture toughness value occur. Therefore, the content of V is set to 0.10 to 0.30%. The V content is preferably 0.14% or more, and preferably 0.29% or less.

N: 0.005 to 0.030%

N (nitrogen) has a function of enhancing the transverse fatigue strength of non-thermally refined hot-forged section material by combining with V to form fine nitrides or carbonitrides. Also, N combines with Al to form fine AlN to suppress the growth of austenite grains during hot forging due to the pinning effect. Therefore, N has an effect of refing the structure of hot-forged section material, and increasing the fracture toughness value. For this purpose, 0.005% or more of N has to be contained. However, if the content of N is more than 0.030%, pinholes are sometimes formed in the steel. Therefore, the content of N is set to 0.005 to 0.030%. The N content is preferably 0.008% or more, and preferably 0.020% or less.

The chemical composition of the rolled steel bar for hot forging and the hot-forged section material of the present invention consists of the above-described elements ranging from C to N, the balance being Fe and impurities. As described already, the term "impurities" means components that are mixed in from raw materials such as ore and scrap, production environments, and the like when the steel is produced on an industrial basis.

In the present invention, however, the contents of P and O in the impurities are required to be restricted so that P: 0.035% or less and O: 0.0030% or less. Hereunder, this requirement is explained.

P: 0.035% or less

P (phosphorus) is an element contained in a steel as an impurity. Especially if the content of P is more than 0.035%, segregation is remarkable, and thereby the transverse fatigue strength may be decreased. Therefore, the content of P is set to 0.035% or less. The P content is preferably 0.030% or less. Also, it is desirable to set the content of P contained as an impurity as low as possible as far as the cost of steel-making process is not raised.

O: 0.0030% or less

O (oxygen) combines with a deoxidizing element such as Al, Si, to form oxides. A coarse oxide serves as a starting point of fatigue fracture, and decreases the transverse fatigue strength of non-thermally refined hot-forged section material. In particular, the existence of oxide having a great width causes a decrease in transverse fatigue strength. If the content of O is more than 0.0030%, it is difficult to make the predicted maximum width of nonmetallic inclusions 100 μm or smaller, and resultantly the transverse fatigue strength is decreased. Therefore, the content of O is set to 0.0030% or less. The O content is preferably 0.0015% or less. Also, it is desirable to set the content of O contained as an impurity as low as possible as far as the cost of steel-making process is not raised.

Another feature of the rolled steel bar for hot forging and the hot-forged section material of the present invention is to contain one or more elements selected from (a) Ti, and (b) Cu, Ni, Cr and Mo, each having a content described below, in lieu of a part of Fe.

Ti: 0.030% or less

Ti (titanium) has an effect of suppressing the growth of austenite grains by combining with N to form TiN. Therefore, Ti makes the structure of hot-forged section material fine, and can increase the fracture toughness value. For this purpose, Ti may be contained as necessary. However, if the content of Ti is more than 0.030%, the precipitation strengthening due to Ti carbides is remarkable, and thereby the fracture toughness value may be decreased. Therefore, the content of Ti, if being contained, is set to 0.030% or less. The Ti content is preferably 0.020% or less. In order to steadily achieve the above-described effects, it is preferable to contain 0.002% or more of Ti. Further preferably, 0.004% or more of Ti is contained.

Cu: 0.30% or less

Cu (copper) is an element for strengthening a steel by means of solid-solution strengthening, and therefore Cu may be contained as necessary. However, if the content of Cu is more than 0.30%, not only the effect thereof is saturated, but also the hardenability is enhanced, and bainite is formed undesirably after hot forging, whereby the fracture toughness value and machinability may be decreased. Therefore, the content of Cu, if being contained, is set to 0.30% or less. The Cu content is preferably 0.20% or less. In order to steadily achieve the above-described effect, it is preferable to contain 0.03% or more of Cu. Further preferably, 0.05% or more of Cu is contained.

Ni: 0.20% or less

Ni (nickel) is an element for strengthening a steel by means of solid-solution strengthening, and therefore Ni may be contained as necessary. However, if the content of Ni is more than 0.20%, not only the effect thereof is saturated, but also the hardenability is enhanced, and bainite is formed undesirably after hot forging, whereby the fracture toughness value and machinability may be decreased. Therefore, the content of Ni, if being contained, is set to 0.20% or less. The Ni content is preferably 0.10% or less. In order to steadily achieve the above-described effect, it is preferable to contain 0.03% or more of Ni. Further preferably, 0.05% or more of Ni is contained.

Cr: 0.50% or less

Cr (chromium) is an element for strengthening a steel by means of solid-solution strengthening. Therefore, in the case where it is desired to enhance the tensile strength, Cr may be contained. However, if the content of Cr is more than 0.50%, not only the effect thereof is saturated, but also the hardenability is enhanced, and bainite is formed undesirably after hot forging, whereby the fracture toughness value and machinability may be decreased. Therefore, the content of Cr, if being contained, is set to 0.50% or less. The Cr content is preferably 0.30% or less. In order to steadily achieve the above-described effect, it is preferable to contain 0.03% or more of Cr. Further preferably, 0.05% or more of Cr is contained.

Mo: 0.10% or less

Mo (molybdenum) is an element for strengthening a steel by means of solid-solution strengthening. Therefore, in the case where it is desired to enhance the tensile strength, Mo may be contained. However, if the content of Mo is more than 0.10%, not only the effect thereof is saturated, but also the hardenability is enhanced, and bainite is formed undesirably after hot forging, whereby the fracture toughness value and machinability may be decreased. Therefore, the content of Mo, if being contained, is set to 0.10% or less. The Mo content is preferably 0.08% or less. In order to steadily achieve the above-described effect, it is preferable to contain 0.02% or more of Mo. Further preferably, 0.04% or more of Mo is contained.

Only one element of Cu, Ni, Cr and Mo can be contained, or two or more elements selected from these elements can be contained compositely. The total amount in the case where these elements are contained compositely is preferably 0.60% or less.

Fn1: 0.90 to 1.20

Fn1 is a parameter that is represented by the following Formula (i), and affords an index of the influence exerted on tensile strength. For the hot-forged section material obtained by hot forging using the rolled steel bar for hot forging, in order to assure a high tensile strength of 900 MPa or higher even in the case where the ratio of ferrite in the ferrite/pearlite structure is increased, the content of each element has to be controlled so that the value of Fn1 is within the defined range. If the value of Fn1 is smaller than 0.90, the tensile strength of the non-thermally refined hot-forged section material decreases, so that a desired transverse fatigue strength cannot be attained. Therefore, the value of Fn1 has to be set to 0.90 or larger. The value of Fn1 is preferably 0.95 or larger. On the other hand, if the value of Fn1 is larger than 1.20, there is a possibility that bainite may be formed in the hot-forged section material after hot forging. If bainite is formed, the fracture toughness value and machinability of the hot-forged section material are decreased. Therefore, the value of Fn1 is set to 1.20 or smaller. The value of Fn1 is preferably 1.16 or smaller.

$$Fn1=C+Si/10+Mn/5+5Cr/22+1.65V-5S/7 \quad \text{(i)}$$

where, the symbol of an element in Formula (i) represents the content (mass %) of the element.

2. Width of Nonmetallic Inclusion in Rolled Steel Bar for Hot Forging and Hot-Forged Section Material In the rolled steel bar for hot forging and hot-forged section material according to the present invention, the predicted maximum width of nonmetallic inclusions at the time when a cumulative distribution function obtained by extreme value statistical processing by taking the width of nonmetallic inclusion in an $R_1/2$ part ($R_1$: radius of rolled steel bar) of a longitudinal cross section, and in an $R_2/2$ part ($R_2$: radius of section material) or in a T/4 part (T: thickness of section material) of a longitudinal cross section as W (μm) is 99.99% is made 100 μm or narrower.

The predicted maximum width of nonmetallic inclusions at the time when a cumulative distribution function obtained by extreme value statistical processing is 99.99% can be determined by the method described below. Hereunder, explanation is given of the case of the rolled steel bar for hot forging only. The same is true for the case of the hot-forged section material.

Ten test specimens each measuring 5 mm wide×15 mm long are cut out so that the longitudinal cross section including the $R_1/2$ part of the rolled steel bar for hot forging is a surface to be inspected, and thereafter is mirror polished. The polished surface is made the surface to be inspected. Subsequently, by making the area to be inspected of one visual field 2.954 $mm^2$, which is a range observed under an optical microscope having a magnification of ×100, five visual fields per one test specimen, that is, a total of 50 visual fields are observed, and the width W (μm) of inclusion having the maximum width of the nonmetallic inclusions observed in each visual field is measured.

The value of width W of inclusion having the maximum width in each visual field, which has been determined as described above, is rearranged in ascending order for 50 visual fields, and each width value is made $W_j$ (j=1 to 50). For respective j, a cumulative distribution function of $F_j$=100 (j/51) (%) is calculated.

A graph in which the normalization variable $Y_j$ represented by the following formula is chosen as the ordinate, and $W_j$ is chosen as the abscissa is prepared, and an approximate straight line is determined by the least-squares method.

$$Y_j=-\ln(-\ln(j/51))$$

From the straight line determined by the least-squares method, the value of $W_j$ at the time when the cumulative distribution function is 99.99% (that is, when the normalization variable $Y_j$=9.21) is read, and the read value is determined to the "predicted maximum width of nonmetallic inclusions at the time when the cumulative distribution function obtained by extreme value statistical processing is 99.99%". FIG. 1 shows an example of the case where the predicted maximum width of nonmetallic inclusions at the time when the cumulative distribution function obtained by extreme value statistical processing is 99.99% is 41.7 μm.

In a common rail in which a tensile stress is applied to the circumferential direction of the inner surface of the through hole formed in the center part of the hot-forged section material, if a nonmetallic inclusion having a great width exists near the inner surface of the through hole, the fatigue strength is decreased. The fatigue strength as the common rail relates closely to the transverse fatigue strength in the non-thermally refined hot-forged section material.

The common rail is formed by pressing down the rolled steel bar for hot rolling in the direction perpendicular to the rolling direction of the rolled steel bar. To the hot-forged section material formed by pressing down the rolled steel bar in this direction, the sizes and distribution state of nonmetallic inclusions in the rolled steel bar, which inclusions have been elongated in the rolling direction due to hot rolling, are transferred almost as they are. Therefore, the transverse fatigue strength in the hot-forged section material is affected by the predicted maximum width of nonmetallic inclusions of the rolled steel bar. The nonmetallic inclusions mean oxides, sulfides, and nitrides existing in a steel. The nonmetallic inclusions of the rolled steel bar are elongated by hot rolling, and are cut, so that the widths thereof are decreased. If a nonmetallic inclusion having a great width exists in the rolled steel bar, the transverse fatigue strength of the hot-forged section material is decreased.

The predicted maximum width of nonmetallic inclusions of the rolled steel bar, which is obtained by extreme value statistical processing, can be decreased, for example, by the method described below.

Coarse oxides consisting mainly of $Al_2O_3$ can exist in the steel with a certain probability. Since oxides agglomerate in the molten steel, being formed into clusters, and are coarsened, oxides are removed sufficiently at the stage of refining. Further, the oxides agglomerating at the refining stage are removed and solidified to form a cast piece or an ingot. The cast piece or ingot turns finally to the rolled steel bar for hot forging through a process of steel bar rolling or blooming and steel bar rolling.

Specifically, taking the cross-sectional area of the transverse cross section perpendicular to the direction in which the cast piece or ingot is rolled as $S_O$, and taking the cross-sectional area of the transverse cross section perpendicular to the rolling direction of the rolled steel bar for hot forging at the time when the final hot rolling is finished as SF, a total reduction ratio represented by the ratio between both the cross-sectional areas, that is, $S_O/S_F$ is made 40 or higher. By making the total reduction ratio ($S_O/S_F$) from cast piece to rolled steel bar 40 or higher, the oxides, sulfides, and nitrides are elongated or cut, so that the predicted maximum width of nonmetallic inclusions of the rolled steel bar can easily be made smaller than 100 μm.

If the reduction ratio is increased, the predicted maximum width of nonmetallic inclusions of the rolled steel bar decreases. However, in order to increase the reduction ratio, the size of cast piece or ingot has to be increased. On the other hand, if the size of cast piece or ingot is increased excessively, in the subsequent blooming or steel bar rolling, the number of rolling passes increases remarkably, and thereby the productivity is degraded remarkably. Therefore, the upper limit of reduction ratio is preferably set to 600.

3. Number Density of Fine Sulfides in Rolled Steel Bar for Hot Forging

If fine sulfides each having a circle-equivalent diameter of 0.3 to 1.0 μm exist at a predetermined number density in the rolled steel bar for hot forging, there is achieved an effect of suppressing the growth of austenite grains during hot forging due to the pinning effect of crystal grain boundary. The sulfides each having a circle-equivalent diameter of smaller than 0.3 μm are dissolved by heating during hot forging, so that there is a possibility that the pinning effect cannot be achieved sufficiently. On the other hand, for the sulfides each having a circle-equivalent diameter of 1.0 μm or larger, a remarkable pinning effect of crystal grain boundary cannot be anticipated. Also, if the number density of sulfides each having a circle-equivalent diameter of 0.3 to 1.0 μm is lower than 500 pieces/mm$^2$, the pinning effect of crystal grain boundary is insufficient, and the structure after hot forging is coarse, whereby the fracture toughness value of the hot-forged section material may be decreased. Therefore, in the rolled steel bar for hot forging according to the present invention, the number density of sulfides each having a circle-equivalent diameter of 0.3 to 1.0 μm observed per unit area in the $R_1/2$ part of the transverse cross section is made 500 pieces/mm$^2$ or higher. The number density of sulfides is preferably 800 pieces/mm$^2$ or higher.

The number density of sulfides each having a circle-equivalent diameter of 0.3 to 1.0 μm of the rolled steel bar is greatly affected by the solidifying condition during casting of the steel, the heating condition during subsequently rolling of the steel bar, or the heating condition during blooming and rolling of the steel bar. Concerning the solidifying condition, specifically, as the cooling rate from solidification start to solidification finish increases, the number density of sulfides each having a circle-equivalent diameter of 0.3 to 1.0 μm of the rolled steel bar can be increased. The cooling rate from solidification start to solidification finish can be estimated by using the following formula described in Non-patent Document 1 by cutting a test specimen out of the transverse cross section of cast piece or ingot and by measuring the secondary arm space of dendrite. In order to make the number density of sulfides each having a circle-equivalent diameter of 0.3 to 1.0 μm of the rolled steel bar 500 pieces/mm$^2$ or higher, the cooling rate from solidification start to solidification finish thus estimated is preferably made 35° C./min or higher.

$$S=710R^{-0.39}$$

where, S is a space (μm) between secondary dendrite arms at the middle position between the center and the surface of cast piece or ingot, and R is an average cooling rate (° C./min) from solidification start to solidification finish.

In order to make the average cooling rate from solidification start to solidification finish 35° C./min or higher, the casting rate has only to be made 0.3 to 1.2 m/min, for example, when a 300 mm×400 mm cast piece is produced by continuous casting.

Furthermore, in order to make the number density of sulfides each having a circle-equivalent diameter of 0.3 to 1.0 μm of the rolled steel bar 500 pieces/mm$^2$ or higher in the process in which the rolled steel bar is produced by using the cast piece or ingot cast under this condition, it is preferable to avoid heating at a temperature of 1300° C. or higher at the heating stage of blooming and steel bar rolling. The number density of sulfides each having a circle-equivalent diameter of 0.3 to 1.0 μm of the rolled steel bar is affected by the heating condition during blooming and rolling of the steel bar. In particular, if heating is performed at a temperature of 1300° C. or higher, fine sulfides are dissolved, or undergo the Ostwald growth, so that the number density of sulfides each having a circle-equivalent diameter of 0.3 to 1.0 of the rolled steel bar can be made 500 pieces/mm$^2$ or higher.

4. Metal Micro-Structure of Hot-Forged Section Material

For the hot-forged section material, in order to assure excellent transverse fatigue strength, fracture toughness value, and machinability, the internal structure of the hot-forged section material has to be made a ferrite/pearlite structure. If bainite or martensite is recognized in the microstructure, the fracture toughness value and machinability are decreased remarkably.

Also, in order to obtain a hot-forged section material having a great fracture toughness value, the structure after hot forging has to be refined. Specifically, the average pearlite grain size in the $R_2/2$ part or the T/4 part of the transverse cross section of the section material has to be made 150 μm or smaller. If the average pearlite grain size is larger than 150 μm, the fracture toughness value decreases remarkably.

Furthermore, since the through hole is formed by cutting work in the center part of the hot-forged section material when the common rail is produced, the machinability of the center part of the section material has to be good. The machinability of the center part is greatly affected by the micro-structure in addition to the chemical composition. In particular, if the area fraction of pearlite accounting for the micro-structure of the center part is more than 75%, the hardness is increased remarkably, and thereby the machinability is decreased greatly. Therefore, the area fraction of pearlite accounting for the micro-structure of the center part of the hot-forged section material is made 75% or less. On the other hand, if the area fraction of pearlite accounting for the micro-structure of the center part is less than 20%, a tear or the like sometimes occurs during cutting work. Therefore, the area fraction of pearlite accounting for the micro-structure of the center part of the hot-forged section material is preferably made 20% or more.

In order to make the internal structure of the hot-forged section material a ferrite/pearlite structure, to make the average pearlite grain size in the $R_2/2$ part or the T/4 part of the transverse cross section 150 μm or smaller, and to make the area fraction of pearlite accounting for the micro-structure of the center part 75% or less, the number density of sulfides each having a circle-equivalent diameter of 0.3 to 1.0 μm of the rolled steel bar is made 500 pieces/$mm^2$ or higher. In addition, for example, when the rolled steel bar for hot forging defined in the present invention is forged, it is preferable that heating at a temperature of 1280° C. or higher be avoided, and that the average cooling rate from 800° C. to 550° C. after hot forging be made 70° C./min or lower.

By meeting all of the above-described requisites, a rolled steel bar for hot forging and a hot-forged section material that have an excellent transverse fatigue strength and a high fracture toughness value can be obtained.

By forming the intersecting holes by means of cutting work of the hot-forged section material, a common rail used for a diesel engine fuel injection system can be produced.

Hereunder, the present invention is explained more specifically with reference to Examples; however, the present invention is not limited to these Examples. In the explanation below, the heating temperature at the time when the rolled steel bar for hot forging or the hot-forged section material is produced indicates the atmospheric temperature in a furnace, and the rolling temperature and the forging temperature indicate the surface temperature of a steel material being worked.

Example 1

Steels A1 to A30 having the chemical compositions given in Table 1 were melted by the method described below.

TABLE 1

| Steel No. | C | Si | Mn | P | S | Cu | Ni | Cr | Mo | Al | V | Ti | N | T[O] | Fn1 |
|---|---|---|---|---|---|---|---|---|---|---|---|---|---|---|---|
| A1 | 0.34 | 0.54 | 1.23 | 0.007 | 0.019 | | | | | 0.012 | 0.275 | | 0.013 | 0.0011 | 1.08 |
| A2 | 0.31 | 0.50 | 1.24 | 0.012 | 0.010 | | | | | 0.021 | 0.262 | | 0.013 | 0.0010 | 1.03 |
| A3 | 0.39 | 0.46 | 1.35 | 0.010 | 0.016 | | | | | 0.032 | 0.182 | | 0.015 | 0.0009 | 0.99 |
| A4 | 0.29 | 0.55 | 1.35 | 0.019 | 0.012 | | | | | 0.026 | 0.243 | | 0.011 | 0.0007 | 1.01 |
| A5 | 0.36 | 0.52 | 1.34 | 0.013 | 0.022 | | | | | 0.028 | 0.268 | | 0.012 | 0.0016 | 1.11 |
| A6 | 0.31 | 0.53 | 1.18 | 0.008 | 0.024 | | | | | 0.015 | 0.264 | | 0.015 | 0.0010 | 1.02 |
| A7 | 0.38 | 0.65 | 1.37 | 0.011 | 0.025 | | | | | 0.034 | 0.271 | | 0.012 | 0.0014 | 1.15 |
| A8 | 0.39 | 0.76 | 1.21 | 0.008 | 0.020 | | | | | 0.019 | 0.236 | | 0.014 | 0.0015 | 1.08 |
| A9 | 0.43 | 0.52 | 1.25 | 0.008 | 0.018 | | | | | 0.015 | 0.263 | | 0.015 | 0.0009 | 1.15 |
| A10 | 0.38 | 0.60 | 1.22 | 0.010 | 0.018 | | | 0.09 | | 0.020 | 0.260 | | 0.014 | 0.0011 | 1.12 |
| A11 | 0.32 | 0.76 | 1.26 | 0.009 | 0.017 | | | 0.16 | | 0.018 | 0.258 | | 0.014 | 0.0012 | 1.10 |
| A12 | 0.32 | 0.52 | 1.18 | 0.018 | 0.016 | | | 0.14 | | 0.041 | 0.234 | | 0.011 | 0.0015 | 1.01 |
| A13 | 0.32 | 0.51 | 1.24 | 0.014 | 0.015 | | 0.02 | 0.15 | | 0.036 | 0.259 | 0.002 | 0.012 | 0.0009 | 1.07 |
| A14 | 0.32 | 0.53 | 1.26 | 0.011 | 0.016 | | | 0.15 | | 0.033 | 0.275 | 0.002 | 0.010 | 0.0008 | 1.10 |
| A15 | 0.34 | 0.58 | 1.29 | 0.014 | 0.013 | | | 0.15 | | 0.033 | 0.274 | 0.003 | 0.011 | 0.0008 | 1.13 |
| A16 | 0.33 | 0.55 | 1.26 | 0.013 | 0.014 | | | 0.16 | | 0.039 | 0.271 | 0.003 | 0.012 | 0.0008 | 1.11 |
| A17 | 0.40 | 0.55 | 1.12 | 0.010 | 0.021 | 0.10 | | | | 0.035 | 0.215 | | 0.013 | 0.0011 | 1.02 |
| A18 | 0.38 | 0.63 | 1.33 | 0.020 | 0.018 | | 0.05 | | | 0.039 | 0.222 | | 0.009 | 0.0010 | 1.06 |
| A19 | 0.39 | 0.53 | 1.28 | 0.011 | 0.012 | | | | 0.04 | 0.025 | 0.188 | | 0.011 | 0.0013 | 1.00 |
| A20 | 0.37 | 0.68 | 1.39 | 0.012 | 0.015 | | | | | 0.019 | 0.205 | 0.015 | 0.012 | 0.0011 | 1.04 |
| A21 | 0.38 | 0.66 | 1.25 | 0.015 | 0.024 | 0.04 | 0.05 | | 0.03 | 0.028 | 0.212 | | 0.010 | 0.0008 | 1.03 |
| A22 | 0.39 | 0.72 | 1.22 | 0.011 | 0.024 | 0.10 | 0.08 | | | 0.031 | 0.244 | 0.012 | 0.012 | 0.0009 | 1.09 |
| A23 | 0.29 | 0.45 | 1.18 | 0.015 | 0.022 | | | | | 0.028 | 0.150 | | 0.012 | 0.0016 | * 0.80 |
| A24 | 0.43 | 0.75 | 1.38 | 0.009 | 0.010 | | | | | 0.020 | 0.285 | | 0.019 | 0.0016 | * 1.24 |
| A25 | 0.35 | 0.60 | * 1.65 | 0.014 | 0.010 | 0.02 | | | | 0.025 | 0.235 | | 0.013 | 0.0012 | 1.12 |
| A26 | 0.32 | 0.58 | 1.31 | 0.018 | * 0.004 | | | | | 0.022 | 0.225 | 0.004 | 0.013 | 0.0015 | 1.01 |
| A27 | 0.39 | 0.65 | 1.30 | 0.009 | * 0.049 | | | | 0.03 | 0.018 | 0.205 | | 0.013 | 0.0019 | 1.02 |
| A28 | 0.44 | 0.78 | 1.40 | 0.015 | 0.019 | | | 0.16 | | 0.020 | * 0.080 | | 0.012 | 0.0020 | 0.95 |
| A29 | 0.32 | 0.79 | 1.28 | 0.018 | 0.018 | | 0.03 | | | 0.018 | 0.290 | * 0.053 | 0.013 | 0.0012 | 1.12 |
| A30 | 0.36 | 0.41 | 1.35 | 0.019 | 0.027 | | | | | 0.007 | 0.230 | | 0.013 | * 0.0045 | 1.03 |

* indicates that conditions do not satisfy those defined by the present invention.

For steels A1 to A29, after oxidation refining had been performed in a 70-ton converter, skimming was performed, and flux was charged into the molten steels. After the molten steels had been agitated for 40 minutes by using a vacuum molten steel agitating device equipped with arc-type heating equipment (hereinafter, referred to as a "VAD"), the molten steels were subjected to refluxing for 20 minutes by using an RH facility. The molten steels, whose chemical composition had been controlled and from which oxides had been removed, were solidified at a casting rate of 0.7 m/min by using a continuous casting facility, whereby cast pieces each having a transverse cross section of 300 mm×400 mm were prepared.

For steel A30, after oxidation refining had been performed in a 70-ton converter, the molten steels were continuously cast at a casting rate of 0.7 m/min by using a continuous casting facility, whereby cast pieces each having a transverse cross section of 300 mm×400 mm were prepared.

The 300 mm×400 mm cast pieces of steels A1 to A30 obtained by the above-described method were heated at 1250° C. for 120 minutes, and thereafter were turned into 180 mm×180 mm slabs by blooming. Subsequently, the slabs were heated at 1200° C. for 90 minutes, and rolled steel bars each having a diameter of 50 mm were formed in the temperature range of 1100 to 1000° C. The total reduction ratio ($S_O/S_F$) from the cast pieces of steels A1 to A30 to the rolled steel bars was 61.

On the rolled steel bars for hot forging obtained by the above-described method, by using the methods of the following items (A) and (B), the predicted maximum width of nonmetallic inclusions in the rolled steel bar and the number density of sulfides each having a circle-equivalent diameter of 0.3 to 1.0 μm were examined.

(A) Predicted Maximum Width of Nonmetallic Inclusions in Rolled Steel Bar

From the rolled steel bar for hot forging, ten specimens each having a longitudinal cross section measuring 5 mm wide×15 mm long including the $R_1/2$ part of rolled steel bar were cut out, and resin embedding and mirror polishing were performed so that the longitudinal cross section was a surface to be inspected. By performing the extreme value statistical processing by using the method described below, the predicted maximum width of nonmetallic inclusions was estimated.

Observation was made with the area to be inspected in one visual field being 2.954 $mm^2$, which was a range observed under an optical microscope having a magnification of ×100, and of the nonmetallic inclusions of oxides, sulfides, and nitrides observed within that visual field, an inclusion having the maximum width of the widths W of the inclusions was selected. Thereafter, the width thereof was measured with the magnification of the optical microscope being ×1000. Similar measurement was made in five visual fields per one test specimen, totally in 50 visual fields.

The value of width W of nonmetallic inclusion having the maximum width in each visual field, which had been determined as described above, was rearranged in ascending order, and each width value was made $W_j$=1 to 50). For respective j, a cumulative distribution function of $F_j$=100 (j/51) (%) was calculated.

A graph in which the normalization variable $Y_j$ represented by the following formula was chosen as the ordinate, and $W_j$ was chosen as the abscissa was prepared, and an approximate straight line was determined by the least-squares method.

$$Y_j=-\ln(-\ln(j/51))$$

From the straight line determined by the least-squares method, the value of $W_j$ at the time when the cumulative distribution function was 99.99% (that is, when the normalization variable $Y_j$=9.21) was read, and the read value was made the "predicted maximum width of nonmetallic inclusions at the time when the cumulative distribution function obtained by extreme value statistical processing was 99.99%".

(B) Number Density of Sulfides Each Having a Circle-Equivalent Diameter of 0.3 to 1.0 μm of Rolled Steel Bar For the rolled steel bar for hot forging, a specimen having a transverse cross section of 10 mm×10 mm was cut out of the $R_1/2$ part of the rolled steel bar, and resin embedding and mirror polishing were performed so that the transverse cross section was a surface to be inspected. By using the method described below, the number density of sulfides each having a circle-equivalent diameter of 0.3 to 1.0 μm was examined.

The magnification of a scanning electron microscope (SEM) was made ×1000, the observation region of a total area of 1.57 $mm^2$ in a total of 128 visual fields was photographed by backscattered electron image, and thereby the number of sulfides each having a circle-equivalent diameter of 0.3 to 1.0 observed in the observation region was measured. The measured number of sulfides was converted into the number per unit area ($mm^2$).

Table 2 gives the measurement results of the predicted maximum width of nonmetallic inclusions of the rolled steel bar obtained by extreme value statistical processing and the number density of sulfides each having a circle-equivalent diameter of 0.3 to 1.0 μm of the rolled steel bar. The "predicted maximum inclusion width" in Table 2 means the predicted maximum width of nonmetallic inclusions of the rolled steel bar, and the "sulfide number density" means the number density of sulfides each having a circle-equivalent diameter of 0.3 to 1.0 μm of the rolled steel bar.

TABLE 2

| Test No. | Steel No. | Predicted maximum width of nonmetallic inclusions (μm) | Number density of sulfides (pieces/$mm^2$) |
|---|---|---|---|
| 1 | A1 | 32 | 1338 |
| 2 | A2 | 24 | 808 |
| 3 | A3 | 27 | 1062 |
| 4 | A4 | 17 | 895 |
| 5 | A5 | 39 | 1608 |
| 6 | A6 | 42 | 1473 |
| 7 | A7 | 37 | 1532 |
| 8 | A8 | 32 | 1412 |
| 9 | A9 | 29 | 1285 |
| 10 | A10 | 35 | 1251 |
| 11 | A11 | 26 | 1195 |
| 12 | A12 | 47 | 1153 |
| 13 | A13 | 36 | 1189 |
| 14 | A14 | 42 | 1297 |
| 15 | A15 | 38 | 1623 |
| 16 | A16 | 34 | 1326 |
| 17 | A17 | 41 | 1532 |
| 18 | A18 | 39 | 1433 |
| 19 | A19 | 32 | 998 |
| 20 | A20 | 37 | 1325 |
| 21 | A21 | 41 | 1537 |
| 22 | A22 | 21 | 1757 |
| 23 | *A23 | 40 | 1586 |
| 24 | *A24 | 37 | 932 |
| 25 | *A25 | 29 | 879 |
| 26 | *A26 | 16 | *255 |
| 27 | *A27 | *109 | 3900 |
| 28 | *A28 | 43 | 1378 |
| 29 | *A29 | 27 | 1404 |
| 30 | *A30 | *132 | 2138 |

*indicates that conditions do not satisfy those defined by the present invention.

The 50-mm diameter rolled steel bar obtained by rolling as described above was cut to a length of 180 mm, being reheated to 1250° C., and was subjected to hot forging in which the rolled steel bar was pressed down in the direction perpendicular to the rolling direction of the rolled steel bar in the temperature range of 1200 to 1150° C. Thereby, the rolled steel bar was finished into a hot-forged section material having a thickness of about 35 mm and a width of about 60 mm. The hot-forged section material was cooled to room temperature by being allowed to cool in the atmosphere. The cooling rate in the temperature range of 800 to 550° C. was approximately 30° C./min.

On the section material obtained by using the above-described method, the predicted maximum width of nonmetallic inclusions, micro-structure, tensile strength, transverse fatigue strength, fracture toughness value, and machinability of the section material were examined by using the methods of the following items (C) to (H).

(C) Predicted Maximum Width of Nonmetallic Inclusions of Section Material

In the hot-forged section material having a thickness of about 35 mm and a width of about 60 mm, ten specimens each having a longitudinal cross section measuring 5 mm thick×15 mm long including the T/4 part of section material were cut out of a ½ position of width of about 60 mm, and resin embedding and mirror polishing were performed so that the longitudinal cross section was a surface to be inspected. By performing the extreme value statistical processing by using the method described below, the predicted maximum width of nonmetallic inclusions was estimated.

Observation was made with the area to be inspected in one visual field being 2.954 $mm^2$, which was a range observed under an optical microscope having a magnification of ×100, and of the nonmetallic inclusions of oxides, sulfides, and nitrides observed within each visual field, an inclusion having the maximum width of the widths W of the inclusions was selected. Thereafter, the width thereof was measured with the magnification of the optical microscope being ×1000. Similar measurement was made in five visual fields per one test specimen, totally in 50 visual fields.

The value of width W of nonmetallic inclusion having the maximum width in each visual field, which had been determined as described above, was rearranged in ascending order, and each width value was made $W_j$ (j=1 to 50). For respective j, a cumulative distribution function of $F_3$=100 (j/51) (%) was calculated.

A graph in which the normalization variable $Y_3$ represented by the following formula was chosen as the ordinate, and $W_j$ was chosen as the abscissa was prepared, and an approximate straight line was determined by the least-squares method.

$$Y_3=-\ln(-\ln(j/51))$$

From the straight line determined by the least-squares method, the value of $W_j$ at the time when the cumulative distribution function was 99.99% (that is, when the normalization variable $Y_j$=9.21) was read, and the read value was made the "predicted maximum width of nonmetallic inclusions at the time when the cumulative distribution function obtained by extreme value statistical processing was 99.99%".

(D) Micro-Structure of Section Material

In the hot-forged section material having a thickness of about 35 mm and a width of about 60 mm, a specimen having a transverse cross section of 10 mm×10 mm including the T/4 part of section material were cut out of a ½ position of width of about 60 mm. Then, after resin embedding and mirror polishing had been performed so that the transverse cross section was a surface to be inspected, the surface to be inspected was etched with alcohol containing 3% of nitric acid (nital etching reagent), whereby the micro-structure was caused to appear. Subsequently, a micro-structure image was photographed in five visual fields with the magnification of the optical microscope being ×200, and thereby the "phase" in the T/4 part was identified. Further, by using this micro-structure image, an average pearlite grain size was calculated by arithmetically averaging the pearlite grain sizes in the five visual fields. In this case, a pearlite colony group surrounded by ferrite was made a pearlite grain, and the diameter of circle corresponding to the area thereof, that is, the circle-equivalent diameter was made a pearlite grain size.

Further, a specimen having a transverse cross section of 10 mm×10 mm was cut out of the center part of the section material. Then, after resin embedding and mirror polishing had been performed so that the transverse cross section was a surface to be inspected, the surface to be inspected was etched with alcohol containing 3% of nitric acid (nital etching reagent), whereby the micro-structure was caused to appear. Subsequently, a micro-structure image was photographed in five visual fields with the magnification of the optical microscope being ×200. Thereby, by using the photographed image, the area fraction of pearlite accounting for the micro-structure of the center part of the section material was determined by image processing software, and the arithmetic mean value of five visual fields was made the pearlite area fraction of the center part.

Concerning the hot-forged section material in which bainite was recognized in the T/4 part, the measurement of average pearlite grain size and the pearlite area fraction of center part was not made.

(E) Tensile Strength of Section Material

From the T/4 part of the hot-forged section material having a thickness of about 35 mm and a width of about 60 mm, a No. 14A test specimen (diameter of parallel part: 5 mm) specified in JIS Z 2241 (2011) was sampled so that the longitudinal direction of the test specimen was the width direction of the section material, that is, the direction perpendicular to the center axis of the section material, and the center of the parallel part of test specimen was the ½ position of the width of about 60 mm of the section material. Then, a tension test was conducted at room temperature with the gage length being 25 mm, and thereby the tensile strength was determined. The target tensile strength of the section material was 900 MPa or higher.

(F) Transverse Fatigue Strength of Section Material

Both the ends in the width direction of the hot-forged section material having a thickness of about 35 mm and a width of about 60 mm were descaled by milling, and were finished into flat surfaces. Both of the milled ends of the section material and a carbon steel S10C specified in JIS G 4051 (2009) were welded to each other by electron beam welding, and thereby a plate material having a thickness of about 35 mm and a width of 130 mm was prepared. Subsequently, from the T/4 part of the plate material, an Ono type rotating bending test specimen of No. 1 test piece (diameter of parallel apart: 8 mm, length of parallel apart: 17 mm, diameter of gripping part: 15 mm, R of a part between parallel part and gripping part: 24 mm, overall length: 106 mm) specified in JIS Z 2274 (1978) was prepared so that the longitudinal direction of the test specimen was the width direction of the plate material, that is, the direction perpendicular to the center axis of the section material, and the center of the parallel part of test specimen was the ½ position of the width of 130 mm of the plate material.

Then, a rotating bending fatigue test was conducted at room temperature in the atmosphere under the condition that the stress ratio was minus one with the number of test specimens being eight. The smallest value of stress amplitude at endurance of number of cycles of $1.0\times10^7$ or larger was made the transverse fatigue strength. The target transverse fatigue strength of the section material was 430 MPa or higher.

(G) Fracture Toughness Value $K_Q$ of Section Material

Figure 2:
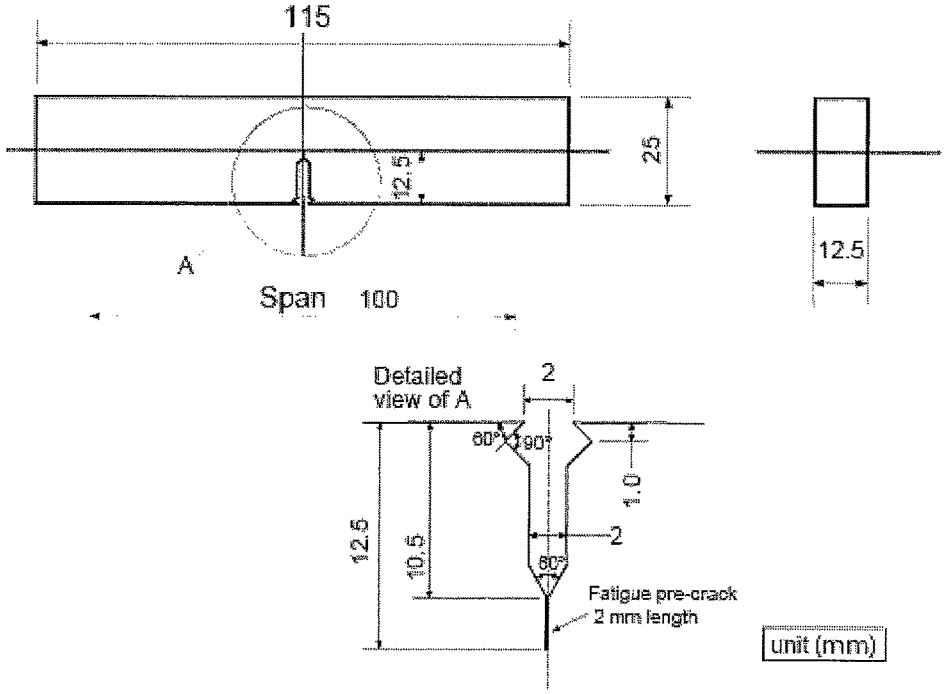
FIG. 2 is views showing the shape of an SE(B) test specimen (length: 115 mm, width: 25 mm, thickness: 12.5 mm) specified in ASTM E 399-06, which is used to determine a fracture toughness value in Examples.

From the T/4 part of the hot-forged section material having a thickness of 35 mm and a width of about 60 mm, an SE (B) test specimen (length: 115 mm, width: 25 mm, thickness: 12.5 mm) specified in ASTM E 399-06 was sampled so that the longitudinal direction of the test specimen was the center axis direction of the section material, and the center of the width of test specimen was the ½ position of the width of about 60 mm of the section material. A notch having a length of 10.5 mm (the length was constant in the test specimen width direction) was formed in the width direction at the center position in the longitudinal direction of the test specimen, and at the front end of the notch, a pre-crack having a length of 2.0 mm was introduced by fatigue load. The shape of test specimen is shown in FIG. 2.

A clip gage was attached to the notch end part of this test specimen so that the opening displacement of notch can be measured. Then, a three-point bending load was applied to the test specimen, that is, a load was applied from the end face on the opposite side just above the notch by supporting the end face on the test specimen notch side at two points with a span of 100 mm. At this time, the load and the change of opening displacement were measured, and from the graph showing the relationship between the both, the load $P_Q$ and the maximum load $P_{max}$, which were the bases of the calculation of fracture toughness value, were determined in conformity to ASTM E 399-06. After it had been confirmed that the condition of $P_{max}/P_Q \leq 1.1$ specified in the above-described standard was met, the stress intensity factor at the time when $P_Q$ was applied to the test specimen was calculated, and the calculated stress intensity factor was made the fracture toughness value $K_Q$. The target fracture toughness value $K_Q$ was 40 MPa·$m^{1/2}$ or higher.

(H) Machinability of Center Part of Section Material

The whole surface of hot-forged section material having a thickness of about 35 mm and a width of about 60 mm was descaled by milling and was finished into a flat surface. Then, after a prepared hole having a depth of 10 mm and a diameter of 9.6 mm had been formed in advance in the center part of the section material, by using a cemented carbide drill formed with a 9.5-mm diameter TiAlN-coated oil hole, piercing was performed to a depth of 90 mm per one hole. At this time, a water-soluble cutting lubricating oil was supplied with the rotating speed of drill being 2011 rpm (cutting speed: about 60 m/min), with the feed per one revolution being 0.10 mm/rev, and with the oil pressure being 2 MPa. The machinability was evaluated by measuring the thrust resistance by using a tool dynamometer, which thrust resistance was imparted to the center axis direction of drill when piercing was performed. At the early stage of piercing, since the variations in cutting resistance were large, the machinability was evaluated by the mean value of thrust resistances measured when 10 holes were pierced. The target machinability was such that the mean value of thrust resistances was 1800 N or smaller. As the index of machinability evaluation, the material in which the mean value of thrust resistances was 1800 N or smaller was judged to be acceptable "O", and the material in which the mean value of thrust resistances was larger than 1800 N was judged to be unacceptable "x".

Table 3 collectively gives the test results. The "predicted maximum inclusion width" in Table 3 means the predicted maximum width of nonmetallic inclusions of the section material.

TABLE 3

| Test No. | Steel No. | Predicted maximum width of nonmetallic inclusions (μm) | Micro-structure | Average pearlite grain size (μm) | Area fraction of pearlite of the center part (%) | Tensile strength (MPa) | Fatigue strength (MPa) | Fracture toughness $K_Q$ (MPa · $m^{1/2}$) | Thrust resistance |
|---|---|---|---|---|---|---|---|---|---|
| 1 | A1 | 30 | F + P | 64 | 45 | 994 | 480 | 58 | ○ |
| 2 | A2 | 24 | F + P | 102 | 39 | 935 | 445 | 61 | ○ |
| 3 | A3 | 26 | F + P | 58 | 62 | 925 | 440 | 66 | ○ |
| 4 | A4 | 14 | F + P | 76 | 32 | 940 | 445 | 63 | ○ |
| 5 | A5 | 36 | F + P | 65 | 46 | 1011 | 460 | 58 | ○ |
| 6 | A6 | 43 | F + P | 54 | 40 | 953 | 455 | 60 | ○ |
| 7 | A7 | 36 | F + P | 62 | 43 | 1045 | 480 | 45 | ○ |
| 8 | A8 | 33 | F + P | 75 | 42 | 1005 | 450 | 68 | ○ |
| 9 | A9 | 27 | F + P | 46 | 62 | 1037 | 475 | 47 | ○ |
| 10 | A10 | 33 | F + P | 92 | 53 | 995 | 470 | 58 | ○ |
| 11 | A11 | 26 | F + P | 76 | 43 | 1010 | 460 | 59 | ○ |
| 12 | A12 | 44 | F + P | 65 | 41 | 952 | 445 | 60 | ○ |
| 13 | A13 | 34 | F + P | 45 | 58 | 985 | 465 | 57 | ○ |
| 14 | A14 | 37 | F + P | 58 | 42 | 1010 | 480 | 62 | ○ |
| 15 | A15 | 35 | F + P | 72 | 47 | 1053 | 495 | 49 | ○ |
| 16 | A16 | 34 | F + P | 73 | 41 | 1028 | 490 | 58 | ○ |
| 17 | A17 | 42 | F + P | 82 | 62 | 942 | 445 | 70 | ○ |
| 18 | A18 | 38 | F + P | 84 | 50 | 960 | 450 | 56 | ○ |
| 19 | A19 | 29 | F + P | 78 | 52 | 920 | 435 | 60 | ○ |
| 20 | A20 | 36 | F + P | 35 | 48 | 935 | 445 | 58 | ○ |
| 21 | A21 | 39 | F + P | 63 | 49 | 933 | 440 | 57 | ○ |
| 22 | A22 | 22 | F + P | 42 | 52 | 972 | 460 | 52 | ○ |
| 23 | * A23 | 39 | F + P | 50 | 25 | 842 | 400 | 67 | ○ |
| 24 | * A24 | 36 | * F + P + B | — | — | 1205 | 470 | 37 | X |
| 25 | * A25 | 30 | * F + P + B | — | — | 1098 | 440 | 38 | X |
| 26 | * A26 | 15 | F + P | * 258 | 42 | 965 | 460 | 38 | ○ |
| 27 | * A27 | * 103 | F + P | 43 | 31 | 930 | 420 | 65 | ○ |
| 28 | * A28 | 42 | F + P | 96 | 46 | 915 | 405 | 70 | ○ |
| 29 | * A29 | 26 | F + P | 32 | 29 | 1088 | 534 | 35 | ○ |
| 30 | * A30 | * 119 | F + P | 67 | 48 | 925 | 400 | 54 | ○ |

* indicates that conditions do not satisfy those defined by the present invention.

In test Nos. 1 to 22, since steels A1 to A22 used each had the chemical composition within the range of chemical composition defined in the present invention, and each had the predicted maximum width of nonmetallic inclusions and the number density of sulfides each having a circle-equivalent diameter of 0.3 to 1.0 μm within the ranges of these values of the rolled steel bar defined in the present invention, all of the tensile strength, transverse fatigue strength, fracture toughness value, and machinability of the hot-forged section material exhibited excellent property values.

In test No. 23, although the chemical composition of steel A23 used was within the range defined in the present invention, the value of Fn1 was as small as 0.80, being smaller than the value defined in the present invention, so that the tensile strength of the hot-forged section material was as low as 842 MPa, and the transverse fatigue strength thereof was as low as 400 MPa.

In test No. 24, although the chemical composition of steel A24 used was within the range defined in the present invention, the value of Fn1 was as large as 1.24, being larger than the value defined in the present invention, and bainite was recognized in the hot-forged section material, so that the fracture toughness value was as low as 37 MPa·m$^{1/2}$, and the value of thrust resistance was larger than 1800 N.

In test No. 25, the content of Mn in steel A25 used was as high as 1.65%, being higher than the upper limit value defined in the present invention, and bainite was recognized in the section material, so that the fracture toughness value was as low as 38 MPa·m$^{1/2}$, and the value of thrust resistance also was larger than 1800 N.

In test No. 26, the content of S in steel A26 used was as low as 0.004%, being lower than the value defined in the present invention, so that the number density of sulfides each having a circle-equivalent diameter of 0.3 to 1.0 μm of the rolled steel bar was as low as 255 pieces/mm$^2$. Therefore, the average pearlite grain size of the section material became large, being 258 μm, and the fracture toughness value was as low as 38 MPa·m$^{1/2}$.

In test No. 27, the content of Sin steel A27 used was as high as 0.049%, being higher than the value defined in the present invention, so that the predicted maximum width of nonmetallic inclusions of the rolled steel bar was as large as 109 μm. Therefore, the transverse fatigue strength of the section material was as low as 420 MPa.

In test No. 28, the content of V in steel A28 used was as low as 0.080%, being lower than the value defined in the present invention. Therefore, the transverse fatigue strength of the section material was as low as 405 MPa.

In test No. 29, the content of Ti in steel A29 used was as high as 0.053%, being higher than the value defined in the present invention. Therefore, the fracture toughness value of the section material was as low as 35 MPa·m$^{1/2}$.

In test No. 30, the content of O in steel A30 used was as high as 0.0045%, being higher than the value defined in the present invention, so that the predicted maximum width of nonmetallic inclusions of the rolled steel bar was as large as 132 μm. Therefore, the transverse fatigue strength of the hot-forged section material was as low as 400 MPa.

Example 2

There is described an example in which even if the chemical composition of the rolled steel bar for hot forging is the same, due to the difference in production conditions of rolled steel bar, especially the difference in cooling rate from solidification start to solidification finish, the structure of hot-forged section material differs, and the mechanical properties change.

Steels B1 and B2 each having the chemical compositions given in Table 4 were melted by the method below.

TABLE 4

| Steel No. | C | Si | Mn | P | S | Cr | Al | V | N | T[O] | Fn1 |
|---|---|---|---|---|---|---|---|---|---|---|---|
| B1 | 0.32 | 0.51 | 1.24 | 0.014 | 0.015 | 0.15 | 0.033 | 0.275 | 0.0100 | 0.0015 | 1.10 |
| B2 | 0.31 | 0.50 | 1.23 | 0.008 | 0.016 | 0.15 | 0.028 | 0.259 | 0.0085 | 0.0016 | 1.06 |

For steel B1, after oxidation refining had been performed in a 70-ton converter, skimming was performed, and flux was charged into the molten steel. After the molten steel had been agitated for 40 minutes by using a VAD, the molten steel was subjected to refluxing for 20 minutes by using an RH facility. The molten steel, whose chemical composition had been controlled and from which oxides had been removed, was continuously cast at a casting rate of 0.7 m/min by using a continuous casting facility, whereby a cast piece having a transverse cross section of 300 mm×400 mm was prepared.

To estimate the cooling rate from solidification start to solidification finish, a small piece having a transverse cross section measuring 15 mm thick×15 mm wide was cut out of a position of ¼ of thickness 300 mm and ½ of width 400 mm of the prepared cast piece. After mirror polishing had been performed with the transverse cross section of the cut-out specimen being a surface to be inspected, the structure was caused to appear by using a picric acid etching reagent. The dendrite structure was observed under an optical microscope, and the dendrite secondary arm space was measured. For the dendrite secondary arm space, on the photograph of dendrite structure, the secondary arm space of dendrite was measured by using calipers, and the actual dimension was determined by dividing the measured space by the photographing magnification of the photograph.

As the result, it was estimated that the dendrite secondary arm space was about 142 μm, and the cooling rate from solidification start to solidification finish was about 62° C./min.

For steel B2, after the steel had been melted by using a 24-ton electric furnace, the molten steel, in which the chemical composition had been controlled and from which oxides had been removed by performing 90-minute treatment by using a ladle refining furnace equipped with vacuum degassing equipment (LFV), was solidified by being cast in a mold made of refractory, whereby an ingot having a height of 2000 mm, a cross section of 500 mm×500 mm at the ½ position of the height of 2000 mm, and a weight of about 3.5 tons was prepared.

Like steel B1, to estimate the cooling rate from solidification start to solidification finish, a small piece having a transverse cross section measuring 15 mm thick×15 mm wide was cut out of a position of ½ of height 2000 mm, ¼ of thickness 500 mm, and ½ of width 500 mm of the ingot.

After mirror polishing had been performed with the transverse cross section of the cut-out specimen being a surface to be inspected, the structure was caused to appear by using a picric acid etching reagent. The dendrite structure was observed under an optical microscope, and the dendrite secondary arm space was measured. For the dendrite secondary arm space, on the photograph of dendrite structure, the secondary arm space of dendrite was measured by using calipers, and the actual dimension was determined by dividing the measured space by the photographing magnification of the photograph.

As the result, it was estimated that the dendrite secondary arm space was about 235 μm, and the cooling rate from solidification start to solidification finish was about 17° C./min.

The cast piece of steel B1 and the ingot of steel B2, which had been obtained by the above-described methods, were each heated at 1250° C. for 120 minutes, and thereafter slabs measuring 180 mm×180 mm were produced by blooming. Subsequently, the slabs were heated at 1200° C. for 90 minutes, and were rolled into steel bars in the temperature range of 1100 to 1000° C., whereby rolled steel bars for hot forging each having a diameter of 50 mm were produced. The total reduction ratio ($S_O/S_F$) from the cast piece to the rolled steel bar of steel B1 was 61, and the total reduction ratio ($S_O/S_F$) from the ingot to the rolled steel bar of steel B2 was 127.

On the rolled steel bar of test No. 31 of steel B1 and the rolled steel bar of test No. 32 of steel B2, which had been obtained by the above-described method, the predicted maximum width of nonmetallic inclusions and the number density of sulfides each having a circle-equivalent diameter of 0.3 to 1.0 μm were examined by the methods described in (A) and (B) of Example 1, respectively.

The examination results are given in Table 5. The "predicted maximum inclusion width" in Table 5 means the predicted maximum width of nonmetallic inclusions of the rolled steel bar, and the "sulfide number density" means the number density of sulfides each having a circle-equivalent diameter of 0.3 to 1.0 μm of the rolled steel bar.

As the result, for the rolled steel bar of test No. 31, the number density of sulfides each having a circle-equivalent diameter of 0.3 to 1.0 μm was 1063 pieces/mm$^2$, being not lower than 500 pieces/mm$^2$; in contrast, for the rolled steel bar of test No. 32, the number density of sulfides each having a circle-equivalent diameter of 0.3 to 1.0 μm was 368 pieces/mm$^2$, being lower than 500 pieces/mm$^2$.

TABLE 5

| Test No. | Steel No. | Predicted maximum width of nonmetallic inclusions (μm) | Number density of sulfides (pieces/mm$^2$) |
|---|---|---|---|
| 31 | B1 | 41 | 1063 |
| 32 | B2 | 45 | *368 |

*indicates that conditions do not satisfy those defined by the present invention.

Next, each of the 50-mm diameter rolled steel bars was cut to a length of 180 mm. After being reheated to 1250° C., the rolled steel bar was finished into a hot-forged section material having a thickness of about 35 mm and a width of about 60 mm by being subjected to hot forging, in which the rolled steel bar was pressed down in the direction perpendicular to the rolling direction of rolled steel bar in the temperature range of 1200 to 1150° C., and was cooled to room temperature by being allowed to cool in the atmosphere. The cooling rate in the temperature range of 800 to 550° C. was approximately 30° C./min.

Figure 3:
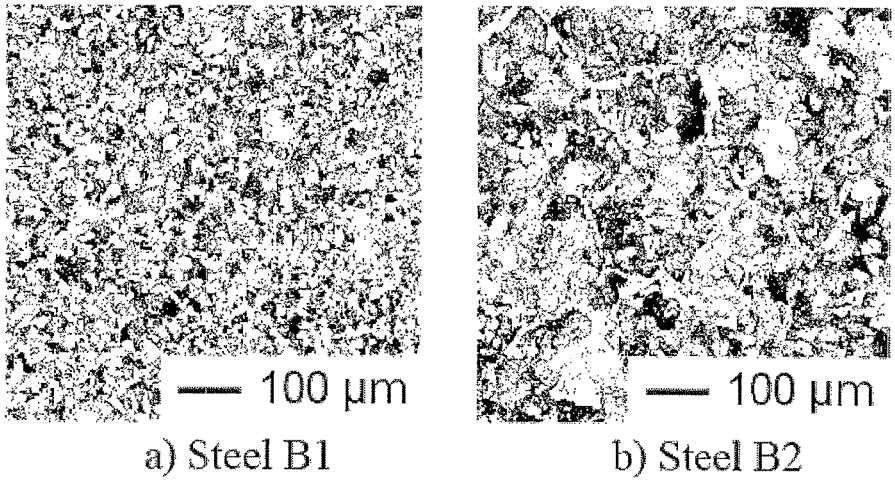
FIGS. 3(*a*) and 3(*b*) are optical microphotographs of micro-structures in a T/4 part at the ½ position of the width of about 60 mm of each of hot-forged section materials of test Nos. 31 and 32, respectively.

FIG. 3 shows the optical microphotographs of micro-structures in a T/4 part at the ½ position of the width of about 60 mm of each of section materials of test Nos. 31 and 32, which micro-structures were observed by the method described in (D) of Example 1.

Also, on the section material obtained by the above-described method, the predicted maximum width of nonmetallic inclusions, micro-structure, tensile strength, transverse fatigue strength, fracture toughness value, and machinability were examined by the testing methods described in (C) to (H) of Example 1. The obtained results are given in Table 6. The "predicted maximum inclusion width" in Table 6 means the predicted maximum width of nonmetallic inclusions of the section material.

The chemical compositions of steel B1 and steel B2 were within the range defined in the present invention, and were almost equivalent to each other; however, the number densities of sulfides each having a circle-equivalent diameter of 0.3 to 1.0 μm of the rolled steel bars used are different. It is found that, for the rolled steel bar of test No. 32, the number density of sulfides each having a circle-equivalent diameter of 0.3 to 1.0 μm was 368 pieces/mm$^2$, being lower than 500 pieces/mm$^2$, and therefore the average pearlite grain size of the section material was 215 μm exceeding 150 μm, being larger than the grain size of 43 μm of test No. 31, so that the micro-structure was coarse. As the result, the hot-forged section material of test No. 32 was poor in fracture toughness value.

TABLE 6

| Test No. | Steel No. | Predicted maximum width of nonmetallic inclusions (μm) | Micro-structure | Average pearlite grain size (μm) | Area fraction of pearlite of the center part (%) | Tensile strength (MPa) | Fatigue strength (MPa) | Fracture toughness $K_Q$ (MPa · m$^{1/2}$) | Thrust resistance |
|---|---|---|---|---|---|---|---|---|---|
| 31 | B1 | 40 | F + P | 43 | 37 | 965 | 455 | 61 | ○ |
| 32 | B2 | 43 | F + P | * 215 | 55 | 1030 | 480 | 39 | ○ |

* indicates that conditions do not satisfy those defined by the present invention.

Example 3

There is described an example in which even if the chemical composition of the roiled steel bar for hot forging is the same, the transverse fatigue strength or the fracture toughness value of the hot-forged section material changes depending on the production conditions of the rolled steel bar.

By using the 300 mm×400 mm cast piece of steel A12 described in Example 1, rolled steel bars for hot forging having a diameter of 50 mm or a diameter of 80 mm were produced under the conditions given in Table 7. The "blooming heating condition" in Table 7 means the heating temperature for performing blooming, the "steel bar heating temperature" means the heating temperature for performing steel bar rolling, and the "steel bar rolling size" means the diameter of rolled steel bar produced by steel bar rolling.

TABLE 7

| Test No. | Steel No. | Blooming heating condition | Blooming size (mm) | Steel bar heating condition | Steel bar rolling size (mm) | Total reduction ratio ($S_O/S_F$) |
|---|---|---|---|---|---|---|
| 33 | A12 | 1250° C. × 120 min | 180 × 180 | 1200° C. × 90 min | 50 | 61 |
| 34 | A12 | 1320° C. × 300 min | 180 × 180 | 1200° C. × 90 min | 50 | 61 |
| 35 | A12 | 1250° C. × 120 min | 180 × 180 | 1310° C. × 120 min | 50 | 61 |
| 36 | A12 | 1250° C. × 120 min | 180 × 180 | 1200° C. × 90 min | 80 | 24 |

On the obtained rolled steel bars, the predicted maximum width of nonmetallic inclusions and the number density of sulfides each having a circle-equivalent diameter of 0.3 to 1.0 μm were examined by the methods described in (A) and (B) of Example 1, respectively. The examination results are given in Table 8. The "predicted maximum inclusion width" in Table 8 means the predicted maximum width of nonmetallic inclusions of the rolled steel bar, and the "sulfide number density" means the number density of sulfides each having a circle-equivalent diameter of 0.3 to 1.0 μm of the rolled steel bar.

TABLE 8

| Test No. | Steel No. | Predicted maximum width of nonmetallic inclusions (μm) | Number density of sulfides (pieces/mm$^2$) |
|---|---|---|---|
| 33 | A12 | 47 | 1153 |
| 34 | A12 | 46 | *470 |
| 35 | A12 | 42 | *359 |
| 36 | A12 | *105 | 895 |

*indicates that conditions do not satisfy those defined by the present invention.

By using the above-described rolled steel bars, hot-forged section materials were prepared.

In test Nos. 33 to 35, each of the 50-mm diameter rolled steel bars was cut to a length of 180 mm. After being reheated to 1250° C., the rolled steel bar was finished into a hot-forged section material having a thickness of about 35 mm and a width of about 60 mm by being subjected to hot forging, in which the rolled steel bar was pressed down in the direction perpendicular to the rolling direction of rolled steel bar in the temperature range of 1200 to 1150° C., and was cooled to room temperature by being allowed to cool in the atmosphere. The cooling rate in the temperature range of 800 to 550° C. was approximately 30° C./min.

In test No. 36, an 80-mm diameter rolled steel bar was cut to a length of 180 mm. After being reheated to 1250° C., the rolled steel bar was finished into a hot-forged section material having a thickness of about 50 mm and a width of about 100 mm by being subjected to hot forging, in which the rolled steel bar was pressed down in the direction perpendicular to the rolling direction of rolled steel bar in the temperature range of 1200 to 1150° C., and was cooled to room temperature by being allowed to cool in the atmosphere. The cooling rate in the temperature range of 800 to 550° C. was approximately 15° C./min.

On the section material obtained by the above-described method, the predicted maximum width of nonmetallic inclusions, micro-structure, tensile strength, transverse fatigue strength, fracture toughness value, and machinability were examined by the testing methods described in (C) to (H) of Example 1. The obtained results are given in Table 9. The "predicted maximum inclusion width" in Table 9 means the predicted maximum width of nonmetallic inclusions of the section material.

TABLE 9

| Test No. | Steel No. | Predicted maximum width of nonmetallic inclusions (μm) | Micro-structure | Average pearlite grain size (μm) | Area fraction of pearlite of the center part (%) | Tensile strength (MPa) | Fatigue strength (MPa) | Fracture toughness $K_Q$ (MPa · m$^{1/2}$) | Thrust resistance |
|---|---|---|---|---|---|---|---|---|---|
| 33 | A12 | 45 | F + P | 65 | 41 | 952 | 445 | 60 | ○ |
| 34 | A12 | 42 | F + P | * 235 | 50 | 1035 | 470 | 38 | ○ |
| 35 | A12 | 39 | F + P | * 186 | 49 | 1043 | 475 | 39 | ○ |
| 36 | A12 | * 104 | F + P | 99 | 38 | 915 | 395 | 55 | ○ |

* indicates that conditions do not satisfy those defined by the present invention.

In test No. 33, since steel A12 had the chemical composition within the range of chemical composition defined in the present invention, and had the predicted maximum width of nonmetallic inclusions and the number density of sulfides each having a circle-equivalent diameter of 0.3 to 1.0 μm within the ranges of these values of the rolled steel bar defined in the present invention, all of the predicted maximum width of nonmetallic inclusions, tensile strength, transverse fatigue strength, fracture toughness value, and machinability of the section material exhibited excellent property values.

In contrast, in test Nos. 34 and 35, although the chemical composition of steel A12 used was within the range defined in the present invention, the number densities of sulfides each having a circle-equivalent diameter of 0.3 to 1.0 μm were 470 pieces/mm$^2$ and 359 pieces/mm$^2$, respectively, being lower than the range defined in the present invention. Therefore, the average pearlite grain sizes of the section materials were 235 μm and 186 μm, respectively, being larger than 150 μm, and the fracture toughness values were as low as 38 MPa·m$^{1/2}$ and 39 MPa·m$^{1/2}$, respectively.

In test No. 36, although the chemical composition of steel A12 used was within the range defined in the present invention, the predicted maximum width of nonmetallic inclusions of the rolled steel bar and the predicted maximum width of nonmetallic inclusions of the section material were 105 μm and 104 μm, respectively, being larger than the range defined in the present invention. Therefore, the transverse fatigue strength of the section material was as low as 395 MPa.

rolled steel bar was formed into a section material having a thickness of about 35 mm and a width of about 60 mm by being subjected to hot forging, in which the rolled steel bar was pressed down in the direction perpendicular to the rolling direction of rolled steel bar in the temperature range of 1200 to 1150° C., and was cooled to room temperature by being fan-cooled. The cooling rate in the temperature range of 800 to 550° C. was approximately 90° C./min.

On the obtained section material, the predicted maximum width of nonmetallic inclusions, micro-structure, tensile strength, transverse fatigue strength, fracture toughness value, and machinability were examined by the testing methods described in (C) to (H) of Example 1. The obtained test results are given in Table 10. The "predicted maximum inclusion width" in Table 10 means the predicted maximum width of nonmetallic inclusions of the section material.

TABLE 10

| Test No. | Steel No. | Predicted maximum width of nonmetallic inclusions (μm) | Micro-structure | Average pearlite grain size (μm) | Area fraction of pearlite of the center part (%) | Tensile strength (MPa) | Fatigue strength (MPa) | Fracture toughness $K_Q$ (MPa · m$^{1/2}$) | Thrust resistance |
|---|---|---|---|---|---|---|---|---|---|
| 37 | A13 | 34 | F + P | 45 | 58 | 985 | 465 | 57 | ○ |
| 38 | A13 | 33 | F + P | * 175 | * 80 | 1035 | 470 | 38 | X |
| 39 | A13 | 36 | * F + P + B | — | — | 1051 | 480 | 39 | X |

* indicates that conditions do not satisfy those defined by the present invention.

Example 4

There is described an example in which even if all of the chemical composition of the rolled steel bar for hot forging, the predicted maximum width of nonmetallic inclusions, and the number density of sulfides with a circle-equivalent diameter of 0.3 to 1.0 μm are the same, the properties of the hot-forged section material change depending on the difference in forging conditions.

By using the 50-mm diameter rolled steel bar for hot forging of steel A13 described in Example 1, a hot-forged section material was prepared under the conditions described below.

In test No. 37, the 50-mm diameter rolled steel bar was cut to a length of 180 mm. After being reheated to 1250° C., the rolled steel bar was formed into a section material having a thickness of about 35 mm and a width of about 60 mm by being subjected to hot forging, in which the rolled steel bar was pressed down in the direction perpendicular to the rolling direction of rolled steel bar in the temperature range of 1200 to 1150° C., and was cooled to room temperature by being allowed to cool in the atmosphere. The cooling rate in the temperature range of 800 to 550° C. was approximately 30° C./min.

In test No. 38, the 50-mm diameter rolled steel bar was cut to a length of 180 mm. After being reheated to 1290° C., the rolled steel bar was formed into a section material having a thickness of about 35 mm and a width of about 60 mm by being subjected to hot forging, in which the rolled steel bar was pressed down in the direction perpendicular to the rolling direction of rolled steel bar in the temperature range of 1250 to 1200° C., and was cooled to room temperature by being allowed to cool in the atmosphere. The cooling rate in the temperature range of 800 to 550° C. was approximately 30° C./min.

In test No. 39, the 50-mm diameter rolled steel bar was cut to a length of 180 mm. After being reheated to 1250° C., the In test No. 37, since steel A13 had the chemical composition within the range of chemical composition defined in the present invention, and had the predicted maximum width of nonmetallic inclusions and the number density of sulfides each having a circle-equivalent diameter of 0.3 to 1.0 μm within the ranges of these values of the rolled steel bar defined in the present invention, and also since the predicted maximum width of nonmetallic inclusions of the section material and the micro-structure within the ranges defined in the present invention, all of the tensile strength, transverse fatigue strength, fracture toughness value, and machinability exhibited excellent property values.

In contrast, in test No. 38, although the chemical composition was within the range of chemical composition defined in the present invention, and the predicted maximum width of nonmetallic inclusions and the number density of sulfides each having a circle-equivalent diameter of 0.3 to 1.0 μm were within the ranges of these values of the rolled steel bar defined in the present invention, since the average pearlite grain size in the T/4 part of the transverse cross section of the section material and the pearlite area fraction in the center part deviated from the range defined in the present invention, the fracture toughness value and machinability were poor.

In test No. 39, although the chemical composition was within the range of chemical composition defined in the present invention, and the predicted maximum width of nonmetallic inclusions and the number density of sulfides each having a circle-equivalent diameter of 0.3 to 1.0 μm were within the ranges of these values of the rolled steel bar defined in the present invention, since the internal structure of the section material was a ferrite/pearlite/bainite structure in which bainite was intermixed, the fracture toughness value and machinability were poor.

Example 5

By using 50-mm diameter rolled steel bars for hot forging that were starting materials for hot-forged section materials excellent in tensile strength, transverse fatigue strength, fracture toughness value, and machinability, and were formed of steel A12 and steel A14 both of which had the chemical composition, the predicted maximum width of nonmetallic inclusions, and the number density of sulfides each having a circle-equivalent diameter of 0.3 to 1.0 μm within the ranges of these values defined in the present invention, common rails for a fuel injection system were produced by the method described below.

Also, for comparison, a 50-mm diameter rolled steel bar formed of steel C1 having the chemical composition given in Table 11 was used. Steel C1 is a steel material corresponding to SCM435 specified in "Low-alloyed Steels for Machine Structural Use" of JIS G 4053 (2008).

TABLE 11

| Steel No. | C | Si | Mn | P | S | Cr | Al | Mo | N | T[O] | Fn1 |
|---|---|---|---|---|---|---|---|---|---|---|---|
| C1 | 0.36 | 0.23 | 0.73 | 0.014 | 0.010 | 1.08 | 0.033 | 0.17 | 0.0120 | 0.0012 | 0.77 |

For steel C1, after oxidation refining had been performed in a 70-ton converter, skimming was performed, and flux was charged into the molten steel. After the molten steel had been agitated for 40 minutes by using a VAD, the molten steel was subjected to refluxing for 15 minutes by using an RH facility. The molten steel, whose chemical composition had been controlled and from which oxides had been removed, was continuously cast at a casting rate of 0.7 m/min by using a continuous casting facility, whereby a cast piece having a transverse cross section of 300 mm×400 mm was prepared.

The 300 mm×400 mm cast piece of steel C1 was heated at 1250° C. for 120 minutes, and thereafter a slab measuring 180 mm×180 mm was produced by blooming. Subsequently, the slab was heated at 1200° C. for 90 minutes, and was rolled into a steel bar in the temperature range of 1100 to 1000° C., whereby a rolled steel bar having a diameter of 50 mm was produced. The total reduction ratio ($S_O/S_F$) from the cast piece to the rolled steel bar of steel C1 was 61.

Figure 4:
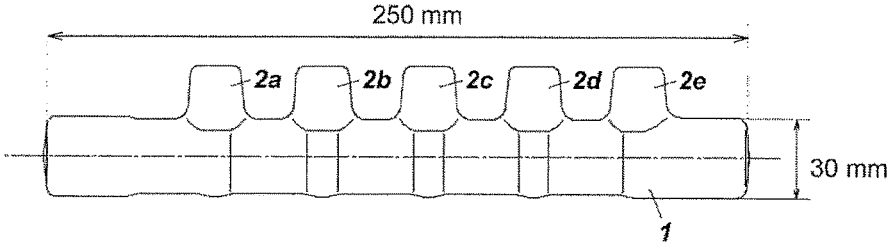
FIG. 4 is a view showing a common rail-shaped hot-forged section material.

Next, each of the 50-mm diameter rolled steel bars for hot forging of steel A12, steel A14, and steel C1 was cut to a length of 250 mm, thereafter being reheated to 1250° C., and was subjected to hot forging, in which the rolled steel bar was pressed down in the direction perpendicular to the rolling direction in the temperature range of 1200 to 1150° C., whereby a common rail-shaped hot-forged section material shown in FIG. 4 was produced, and was cooled to room temperature by being allowed to cool in the atmosphere. The cooling rate in the temperature range of 800 to 550° C. was approximately 45° C./min. The hot-forged section material for common rail was produced by integral molding, and was configured by a shell part 1, which is a common rail body, and five branch parts 2*a* to 2*e*. The outside diameter of the shell part 1 was 30 mm.

On the obtained hot-forged section materials of steel A12 and A14, the predicted maximum width of nonmetallic inclusions, micro-structure, and tensile strength were examined by the testing methods described in (C) to (H) of Example 1. The examination results are given in Table 12. The "predicted maximum inclusion width" in Table 12 means the predicted maximum width of nonmetallic inclusions of the section material. As shown in FIG. 4, on the common rail-shaped section material, the predicted maximum width was determined by taking the width of nonmetallic inclusion in the $R_2/2$ part ($R_2$: radius of the shell part 1) of the longitudinal cross section of the shell part 1, that is, at position 7.5 mm deep from the surface as W (μm). Also, concerning the micro-structure, likewise, the pearlite area fraction of the center part of section material was calculated in the center part of the shell part 1, and the average pearlite grain size was measured in the $R_2/2$ part ($R_2$: radius of the shell part 1) of the transverse cross section of the shell part 1, that is, at position 7.5 mm deep from the surface.

TABLE 12

| Test No. | Steel No. | Predicted maximum width of nonmetallic inclusions (μm) | Micro-structure | Average pearlite grain size (μm) | Area fraction of pearlite of the center part (%) | Tensile strength (MPa) |
|---|---|---|---|---|---|---|
| 40 | A12 | 40 | F + P | 42 | 45 | 920 |
| 41 | A14 | 34 | F + P | 53 | 56 | 977 |

Figure 5:
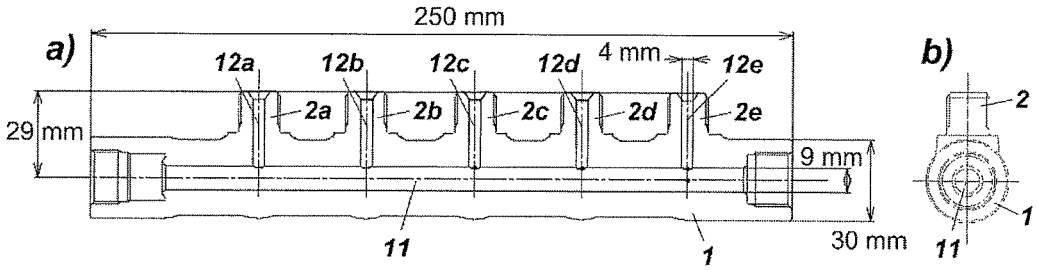
FIG. 5 is views showing a common rail in which, by cutting work, a hot-forged section material is formed with a through hole in the center axis direction in the center part thereof and is formed with minute holes so as to intersect with the through hole, FIG. 5(*a*) being a front view, and FIG. 5(*b*) being a side view.

In the shell part 1 of the common rail-shaped hot-forged section material shown in FIG. 4, a through hole 11 was formed in the center axis direction in the center part thereof by cutting work, and minute holes 12*a* to 12*e* were formed in the five branch parts 2*a* to 2*e* by cutting work so as to intersect with the through hole, whereby a common rail having the shape shown in FIG. 5 was produced. FIG. 5(*a*) is a front view, and FIG. 5(*b*) is a side view. The cutting work was performed by using a gun drill under the conditions that the cutting speed was 70 m/min and the feed per one revolution was 0.03 mm/rev. In test No. 42 in which steel C1 was used, after the cutting work had been performed, oil quenching was performed by heating at 870° C. for 60 minutes, and successively tempering was performed at 600° C. for 90 minutes.

By using the common rail obtained by the above-described method, a fatigue test was conducted. A pressure generating source was connected to the minute hole 12*a* formed in the branch part 2*a* of the five branch parts, and a pressure sensor was provided in an intermediate location between the minute hole and the pressure generating source. All of the end portions of other minute holes 12*b* to 12*e* and both the ends of the through hole 11 formed in the shell part 1 were sealed. Subsequently, oil was supplied under pressure from the minute hole 12*a* connected to the pressure generating source so that the stress is fluctuated periodically (frequency: 15 Hz). The maximum pressure at endurance of number of cycles of $1.0\times10^7$ or larger was made the fatigue strength. The ratio with respect to test No. 42 was determined as a fatigue limit ratio, and evaluation was performed. The pressure was an internal pressure measured by the pressure sensor installed between the pressure generating source and the minute hole 12*a* in the end portion of common rail. The test results are given in Table 13.

TABLE 13

| Test No. | Steel No. | Fatigue limit ratio |
|---|---|---|
| 40 | A12 | 1.03 |
| 41 | A14 | 1.10 |
| 42 | C1 | 1.00 |

In test Nos. 40 and 41 in which all requisites defined in the present invention were met, although being in the non-thermally refined state, a fatigue strength equivalent to or higher than that of test No. 42 subjected to thermal refining treatment could be obtained.

INDUSTRIAL APPLICABILITY

By using the rolled steel bar for hot forging of the present invention as a starting material, a non-thermally refined hot-forged section material excellent in transverse fatigue strength, fracture toughness value, and machinability can be obtained. Also, by forming intersecting holes in the hot-forged section material of the present invention, a common rail for a fuel injection system used at a high injection pressure can be produced at a low cost.

DESCRIPTION OF SYMBOLS

1: shell part
2*a*-2*e*: branch part
11: through hole
12*a*-12*e*: minute hole

What is claimed is:

1. A hot-forged section material consisting of, in mass percent,
C: 0.25 to 0.50%,
Si: 0.40 to 1.0%,
Mn: 1.0 to 1.6%,
S: 0.005 to 0.035%,
Al: 0.005 to 0.050%,
V: 0.10 to 0.30%,
N: 0.005 to 0.030%, and
the balance being Fe and impurities,
wherein
contents of P and O in the impurities being P: 0.035% or less and O: 0.0030% or less, and
Fn1 represented by Formula (i) being 0.90 to 1.20,
wherein the hot-forged section material has
a predicted maximum width of nonmetallic inclusions, W, of 100 μm or narrower, wherein the predicted maximum width of nonmetallic inclusions is determined at a time when a cumulative distribution function obtained by extreme value statistical processing by taking a width of nonmetallic inclusion in an $R_2/2$ part or a T/4 part of a longitudinal cross section of the hot-forged section material is 99.99%;
an internal structure consisting of a ferrite/pearlite structure;
an average pearlite grain size in an $R_2/2$ part or a T/4 part of a transverse cross section of the section material of 150 μm or smaller; and
an area fraction of pearlite accounting for a micro-structure of a center part of the hot-forged section material of 75% or less;
wherein
$R_2$=radius of the hot-forged section material;
T=thickness of the hot-forged section material;

$$Fn1=C+Si/10+Mn/5+5Cr/22+1.65V-5S/7 \quad \text{Formula (i)}$$

wherein the symbol of an element in Formula (i) represents its content in mass %.

2. A hot-forged section material consisting of, in mass percent,
C: 0.25 to 0.50%,
Si: 0.40 to 1.0%,
Mn: 1.0 to 1.6%,
S: 0.005 to 0.035%,
Al: 0.005 to 0.050%,
V: 0.10 to 0.30%,
N: 0.005 to 0.030%,
one or more elements selected from the group consisting of Ti: 0.030 or less, Cu: 0.30% or less, Ni: 0.20% or less, Cr: 0.50% or less and Mo: 0.10% or less, and
the balance being Fe and impurities,
wherein
contents of P and O in the impurities being P: 0.035% or less and O: 0.0030% or less, and
Fn1 represented by Formula (i) being 0.90 to 1.20,
wherein the hot-forged section material has
a predicted maximum width of nonmetallic inclusions, W, of 100 μm or narrower, wherein the predicted maximum width of nonmetallic inclusions is determined at a time when a cumulative distribution function obtained by extreme value statistical processing by taking a width of nonmetallic inclusion in an $R_2/2$ part or a T/4 part of a longitudinal cross section of the hot-forged section material is 99.99%;
an internal structure consisting of a ferrite/pearlite structure;
an average pearlite grain size in an $R_2/2$ part or a T/4 part of a transverse cross section of the section material of 150 μm or smaller; and
an area fraction of pearlite accounting for a micro-structure of a center part of the hot-forged section material of 75% or less;
wherein
$R_2$=radius of the hot-forged section material;
T=thickness of the hot-forged section material;

$$Fn1=C+Si/10+Mn/5+5Cr/22+1.65V-5S/7 \quad \text{Formula (i)}$$

wherein the symbol of an element in Formula (i) represents its content in mass %.

3. A common rail comprising the hot-forged section material of claim 1.

4. A common rail comprising the hot-forged section material of claim 2.

* * * * *